US008579295B2

(12) United States Patent
Noda et al.

(10) Patent No.: US 8,579,295 B2
(45) Date of Patent: Nov. 12, 2013

(54) GAME MACHINE AND GAME METHOD

(75) Inventors: Masataka Noda, Tokyo (JP); Rie Tomimatsu, Tokyo (JP)

(73) Assignees: Kabushiki Kaisha SEGA, Tokyo (JP), part interest; Dartslive Co., Ltd., Tokyo (JP), part interest ( * ) Notice: Subject to any disclaimer, the term of this patent is extended or adjusted under 35 U.S.C. 154(b) by 435 days.

(21) Appl. No.: 12/947,548

(22) Filed: Nov. 16, 2010

(65) Prior Publication Data

US 2012/0018954 A1 Jan. 26, 2012

Related U.S. Application Data

(63) Continuation of application No. 10/979,044, filed on Nov. 1, 2004, now Pat. No. 7,857,317.

(30) Foreign Application Priority Data

Oct. 31, 2003 (JP) ..... 2003-372553

(51) Int. Cl.
*F41J 3/02* (2006.01)

(52) U.S. Cl.
USPC ..... 273/372; 273/118 R; 273/56; 273/87; 273/371; 463/36

(58) Field of Classification Search
None
See application file for complete search history.

(56) References Cited

U.S. PATENT DOCUMENTS

| | | | | | |
|---|---|---|---|---|---|
| 3,989,249 | A * | 11/1976 | Breslow | 273/108.2 |
| 4,293,128 | A * | 10/1981 | Ebel | 273/450 |
| 4,295,650 | A * | 10/1981 | Keeble | 273/118 R |
| 4,995,613 | A * | 2/1991 | Walker | 473/280 |
| 5,558,337 | A * | 9/1996 | Frank, III | 273/408 |
| 5,855,516 | A * | 1/1999 | Eiba | 463/42 |
| 5,971,397 | A * | 10/1999 | Miguel et al. | 273/371 |
| 6,030,109 | A * | 2/2000 | Lobsenz | 700/92 |
| 6,076,021 | A * | 6/2000 | Houriet et al. | 700/93 |
| 6,575,841 | B1 * | 6/2003 | Erdoes et al. | 473/160 |
| 7,857,317 | B2 * | 12/2010 | Noda et al. | 273/372 |
| 2002/0065882 | A1 * | 5/2002 | Arkin et al. | 709/204 |
| 2003/0073472 | A1 * | 4/2003 | Varley | 463/1 |
| 2004/0072625 | A1 * | 4/2004 | Fertig et al. | 473/196 |

FOREIGN PATENT DOCUMENTS

| | | |
|---|---|---|
| JP | 2001-527631 | 12/2001 |
| WO | WO-96/07867 | 3/1996 |

* cited by examiner

*Primary Examiner* — Paul A D'Agostino
(74) *Attorney, Agent, or Firm* — Jordan and Hamburg LLP

(57) ABSTRACT

A game machine is provided with a target, a CRT, a card reader and a cash-box on a front face. A player inserts his own ID card into the card reader. The CRT displays information concerning a game and has a function of a game display when a game adopting darts is executed. A target is both a target hit by an arrow and also a tool by which players obtain points, areas or numerals by arrow throwing. A button is provided on the game machine for "Player Change" of the darts, which is used as an operation input switch for a control unit.

6 Claims, 22 Drawing Sheets

GAME MACHINE AND GAME METHOD

REFERENCE TO RELATED APPLICATION

This is a continuation application of Ser. No. 10/979,044, filed Nov. 1, 2004 which is currently allowed. The subject matter of the aforementioned prior application is hereby incorporated herein by reference.

BACKGROUND OF THE INVENTION

1. Field of the Invention

The present invention relates to a game machine and game method adopting "darts" or other target hitting games.

2. Prior Art

For example, the darts is a traditional game having a history of 500 years mainly aiming at competition of each player's skill of arrow throwing. In the darts, when a player throws the arrow, other players must keep quiet as a manner, so the darts is rather serious than entertaining The darts is poor in atmosphere that a beginner can easily join, that players have much entertaining fun and a sense of unity.

Recently, electric darts machines are spread which automatically detect hit area of the target so as to record and totalize players' points. However, since such darts machines follow the game of the traditional darts, easy entertaining fun and excitation cannot be expected similarly to the conventional darts.

SUMMARY OF THE INVENTION

The present invention is invented so as to solve the above conventional problems and has an object to provide a game machine and game method for a game adopting a target hitting game wherein a beginner can easily join and feel a lot of entertainment.

According to the present invention, a game machine includes arrows thrown by a plurality of players, a target toward which said arrows are thrown and which is divided into a plurality of areas with indicators, a sensor for detecting said area of said target where said arrow hits when said arrow hits said target, a control unit to which a detecting result of said sensor is input, a display monitor controlled by said control unit and a card reader for reading an ID cards of said players, wherein a game is proceeded according to said indicators of said areas, characterized in that an image, specified by said indicator of said area hit by said arrow, is displayed in said display monitor.

According to the present invention, said players are identified by said ID cards, and a playing order of said players is automatically changed during a plurality of rounds of said game is executed.

According to the present invention, a game method for a game wherein a plurality of players successively throw arrows toward an target which is divided into a plurality of areas, and an index is set for each of said areas, said game is advanced according to said index, comprising step of setting an initial point of each of said players, allocating partially said areas to each of said players, adding to said point of said player a point corresponding to said index of said areas where each said player hits, if said area is allocated to said player, subtracting from said point of said player a point corresponding to said index of said areas where each said player hits, if said area is allocated to another of said player, and eliminating said player when said point thereof becomes zero.

According to the present invention a game method for a game wherein a plurality of players successively throw arrows toward an target which is divided into a plurality of areas, and an index is set for each of said areas, said game is advanced according to said index, comprising step of adding to a first point corresponding to said index of said areas where each said player hits, to a first point of said player, Judging whether said first point of said player becomes equal to a first point of another player due to said addition of said first point corresponding to said index, decreasing said first point of said another player if said first point of said player becomes equal to a first point of said another player due to said addition of said first point, giving a predetermined second point to said player if said first point of said player becomes equal to a first point of said another player due to said addition of said first point, giving a predetermined second point to said player if said first point of said player becomes equal to a first point of said another player due to said addition of said first point, giving a predetermined second point to said player if said first point of said player becomes equal to a predetermined upper limit due to said addition of said first point, returning said first point to a initial point if said first point of said player becomes equal to a predetermined upper limit due to said addition of said first point, and decreasing said first point of said player if said first point of said player exceeds said predetermined upper limit due to said addition of said first point.

According to the present invention, a game method for a game wherein a plurality of players successively throw a plurality of arrows in each round toward an target which is divided into a plurality of areas, and an index is set for each of said areas, said game is advanced according to said index, comprising step of; giving said area hit by said player and an area relevant to said hit area, to said player when said index of said hit area is a predetermined index, giving said area repeatedly hit predetermined times in one round by said player and an area relevant to said hit area, to said player when said index of said hit area is a predetermined index, giving a predetermined point to said player when said player obtains said area, giving a point of said area hit by said player to said player when said hit area is already obtained by another player, and said game is terminated when all said areas are owned by said players.

According to the present invention, a game method for a game wherein a plurality of players successively throw an arrow toward an target which is divided into a plurality of areas, and an index is set for each of said areas, said game is advanced according to said index, comprising step of distributing a plurality of cards to each said players, deleting one of said card when said index of said area hit by said player corresponds to said card, and transferring said cards of a predetermined number to another said player when said index of the area hit by said player is a predetermined index.

According to the present invention, a game method for a game wherein a plurality of players successively throw an arrow toward an target which is divided into a plurality of areas, and an index is set for each of said areas, said game is advanced according to said index, comprising step of distributing symbols of castles, symbols of castles' possessions and symbols of castle walls to said players, and giving indexes to each said castle and each castle alls, influencing damaging influence on said castle wall when said index of said area hit by said player corresponds said index given to said castle wall, distinguishing said castle wall when said when said castle wall is of a predetermined damage, influencing damaging influence on said possessions of said castle when said index of said area hit by said player corresponds said index given to said castle and said castle walls of said castle are completely distinguished, distinguishing said castle when said possessions are of determined damage, and restoring said distinguished castle walls when said index of said area hit by said player corresponds said index given to said castle and said castle walls of said castle are completely distinguished.

According to the present invention, a game method for a game wherein a plurality of players successively throw a plurality of arrows in a round toward an target which is divided into a plurality of areas, and an index is set for each of said areas, said game is advanced according to said index, comprising step of allocating an index to each of a plurality of panels, determining a part of said panels to be specified panels, displaying said panels and indicating said specified panels, giving said specified panel to said player when said index of said area hit by said player corresponds to said index of said specified panel, giving said panel owned by another said player to said player when said player obtains panels on opposite sides of said panel owned by another said player, and giving said panel to said player when said index of said area hit by said player corresponds to said index of said specified panel and said specified panel is hit by said player in said same round.

According to the present invention, a game method for a game wherein a plurality of players successively throw a plurality of arrows in a round toward an target which is divided into a plurality of areas, and an index is set for each of said areas, said game is advanced according to said index, comprising step of designating a plurality of said areas, giving said area to said player when said area is said designated area hit a plurality of times by said player and said area is ownerless, giving point corresponding to said index of said area to said player when said area is said designated area hit a plurality of times by said player and said area is owned by said player, and giving point corresponding to said index of said area to all the other player tan said player when said area is not said designated area hit by said player.

According to the present invention, a game machine includes arrows thrown by a plurality of players, a target toward which said arrows are thrown and which is divided into a plurality of areas with indicators, said areas being partially allocated to each of said players, a sensor for detecting said area of said target where said arrow hits when said arrow hits said target, a control unit to which a detecting result of said sensor is input, a display monitor controlled by said control unit and card reader for reading an ID cards of said players, and said control unit includes a displaying means for displaying an image, specified by said indicator of said area hit by said arrow in said display monitor, an initial point setting means for setting an initial point of each of said players, an addition means, a subtraction means, a calculation means for controlling the operation of the addition and subtraction means in accordance with the output of the sensor, so that a point corresponding to said index of said areas where each said player hits is added to said point of said player if said area is allocated to said player, and a point corresponding to said index of said areas where each player hits is subtracted from said point of said player if said area is allocated to another of said players, and an eliminating means for eliminating said player when said point thereof becomes zero.

According to the present invention, a game machine includes arrows thrown by a plurality of players, a target toward which said arrows are thrown and which is divided into a plurality of areas with indicators, said areas being partially allocated to each of said players, a sensor for detecting said area of said target where said arrow hits when said arrow hits said target, a control unit to which a detecting result of said sensor is input, a display monitor controlled by said control unit and a card reader for reading an ID cards of said players, and said control unit includes an addition means for adding a first point corresponding to said index of said areas where each said player hits, to a first point of said player, a judging means for judging whether said first point of said player becomes equal to a first point of another player due to said addition of said first point corresponding to said index, a decreasing means for decreasing said first point of said another player if said first point of said player becomes equal to a first point of said another player due to said addition of said first point, a second point giving means for giving a predetermined second point to said player if said first point of said player becomes equal to a first point of said another player due to said addition of said first point, and for giving a predetermined second point to said player if said first point of said player becomes a predetermined upper limit due to said addition of said first point, a first point returning means for returning said first point to an initial point if said first point of said player becomes said predetermined upper limit due to said addition of said first point, and a decreasing means for decreasing said first point of said player if said first point of said player exceeds said predetermined upper limit due to said addition of said first point.

According to the present invention, a game machine includes arrows thrown by a plurality of players, a target toward which said arrows are thrown and which is divided into a plurality of areas with indicators, said areas being partially allocated to each of said players, a sensor for detecting said area of said target where said arrow hits when said arrow hits said target, a control unit to which a detecting result of said sensor is input, a display monitor controlled by said control unit and a card reader for reading an ID cards of said players, and said control unit includes a first area giving means for giving said area hit by said player and an area relevant to said hit area, to said player when said index of said hit area is a predetermined index, a second area giving means for giving said area repeatedly hit predetermined times in one round by said player and an area relevant to said hit area, to said player when said index of said hit area is a predetermined index, a first point giving means for giving a predetermined point to said player when said player obtains said area, and a second point giving means for giving a point of said area hit by said player to said player when said hit area is already obtained by another player, and a game terminating means for terminating said game when all said areas are owned by said players.

According to the present invention, a game machine includes arrows thrown by a plurality of players, a target toward which said arrows are thrown and which is divided into a plurality of areas with indicators, said areas being partially allocated to each of said players, a sensor for detecting said area of said target where said arrow hits when said arrow hits said target, a control unit to which a detecting result of said sensor is input, a display monitor controlled by said control unit and a card reader for reading an ID cards of said players, and said control unit includes a card distributing means for distributing a plurality of cards to each said players, a card deleting means for deleting one of said card when said index of said area hit by said player corresponds to said card, a card transfer means for transferring said cards of a predetermined number to another said player when said index of the area hit by said player is a predetermined index, and a game terminating means for terminating said game when any one of said players loses all said cards.

According to the present invention, a game machine includes arrows thrown by a plurality of players, a target toward which said arrows are thrown and which is divided into a plurality of areas with indicators, said areas being partially allocated to each of said players, a sensor for detecting said area of said target where said arrow hits when said arrow hits said target, a control unit to which a detecting result of said sensor is input, a display monitor controlled by said control unit and a card reader for reading an ID cards of said players, and said control unit includes a symbol distributing means for distributing symbols of castles, symbols of castles' possessions and symbols of castle walls to said players, a index giving means for giving indexes to each said castle and each castle walls, a wall damage influencing means for influencing damaging influence on said castle wall when said index of said area hit by said player corresponds said index given to said castle wall, a wall eliminating means for eliminating said castle wall when said castle wall is of a predetermined damage, a castle damage influencing means for influencing damaging influence on said possessions of said castle when said index of said area hit by said player corresponds said index given to said castle and said castle walls of said castle are completely distinguished, a castle eliminating means for eliminating said castle when said possessions are of determined damage, and a restoring means for restoring said eliminated castle walls when said index of said area hit by said player corresponds to said index given to said castle and said castle walls of said castle are completely eliminated.

According to the present invention, a game machine includes arrows thrown by a plurality of players, a target toward which said arrows are thrown and which is divided into a plurality of areas with indicators, said areas being partially allocated to each of said players, a sensor for detecting said area of said target where said arrow hits when said arrow hits said target, a control unit to which a detecting result of said sensor is input, a display monitor controlled by said control unit and a card reader for reading an ID cards of said players, and said control unit includes an index allocating means for allocating an index to each of a plurality of panels, a panel specifying means for determining a part of said panels to be specified panels, a panel displaying means for displaying said panels and indicating said specified panels, a first panel giving means for giving said specified panel to said player when said index of said area hit by said player corresponds to said index of said specified panel, a second panel giving means for giving said panel owned by another said player to said player when said player obtains panels on opposite sides of said panel owned by another said player, and a third panel giving means for giving said panel to said player when said index of said area hit by said player corresponds to said index of said specified panel and said specified panel is hit by said player in said same round.

According to the present invention, a game machine includes arrows thrown by a plurality of players, a target toward which said arrows are thrown and which is divided into a plurality of areas with indicators, said areas being partially allocated to each of said players, a sensor for detecting said area of said target where said arrow hits when said arrow hits said target, a control unit to which a detecting result of said sensor is input, a display monitor controlled by said control unit and A card reader for reading an ID cards of said players, said control unit includes a designating means for designating a plurality of said areas, a area giving means for giving said area to said player when said area is said designated area hit a plurality of times by said player and said area is ownerless, a point giving means for giving point corresponding to said index of said area to said player when said area is said designated area hit a plurality of times by said player and said area is owned by said player, and a point giving means for giving point corresponding to said index of said area to all the other player than said player when said area is not said designated area hit by said player.

PREFERRED EMBODIMENT OF THE PRESENT INVENTION

Next, the best mode for carrying out the invention is described with reference to the drawings.

Game Machine

Figure 1:
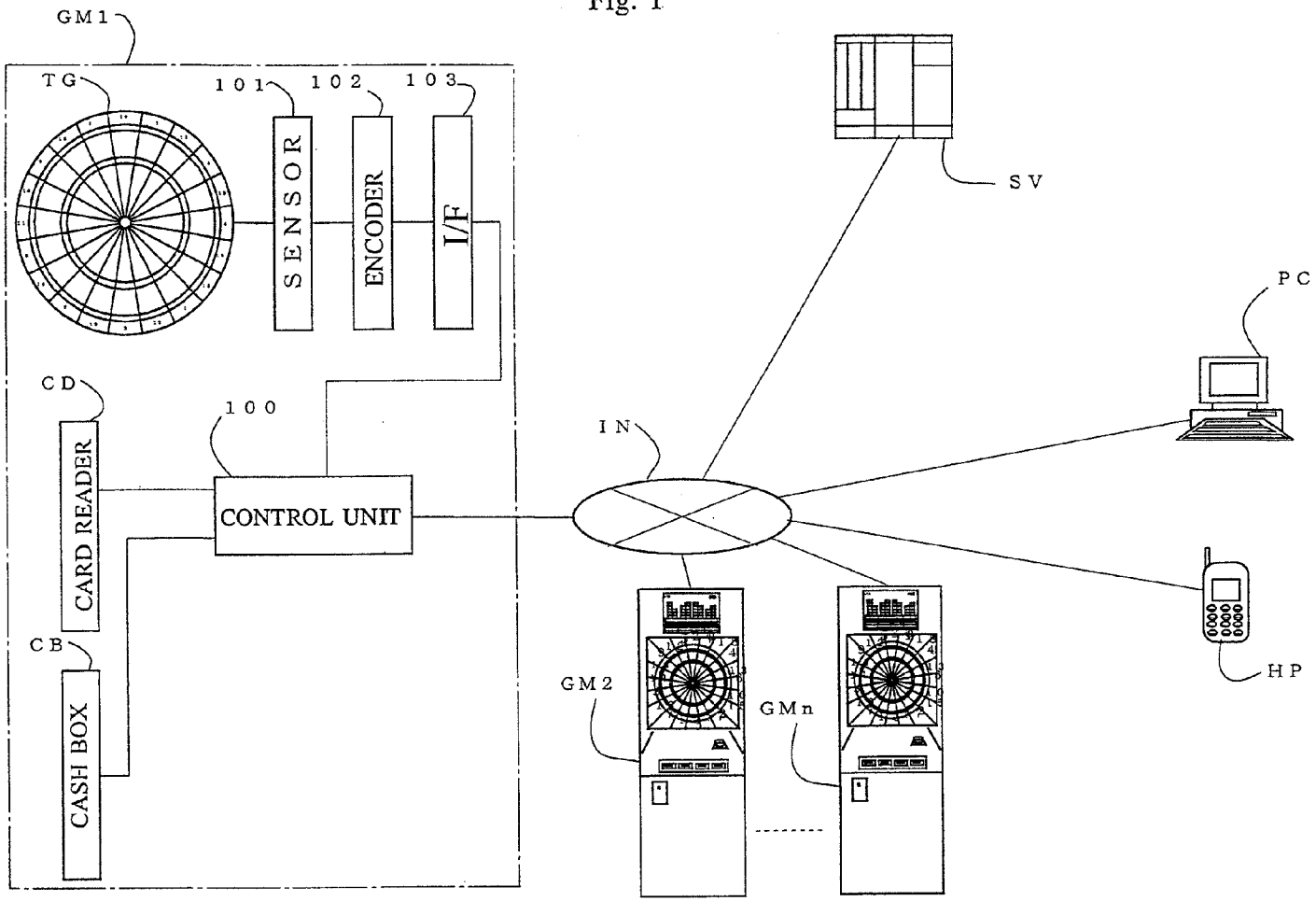
FIG. 1 is a block diagram showing a network including a game machine according to the present invention.
Figure 2:
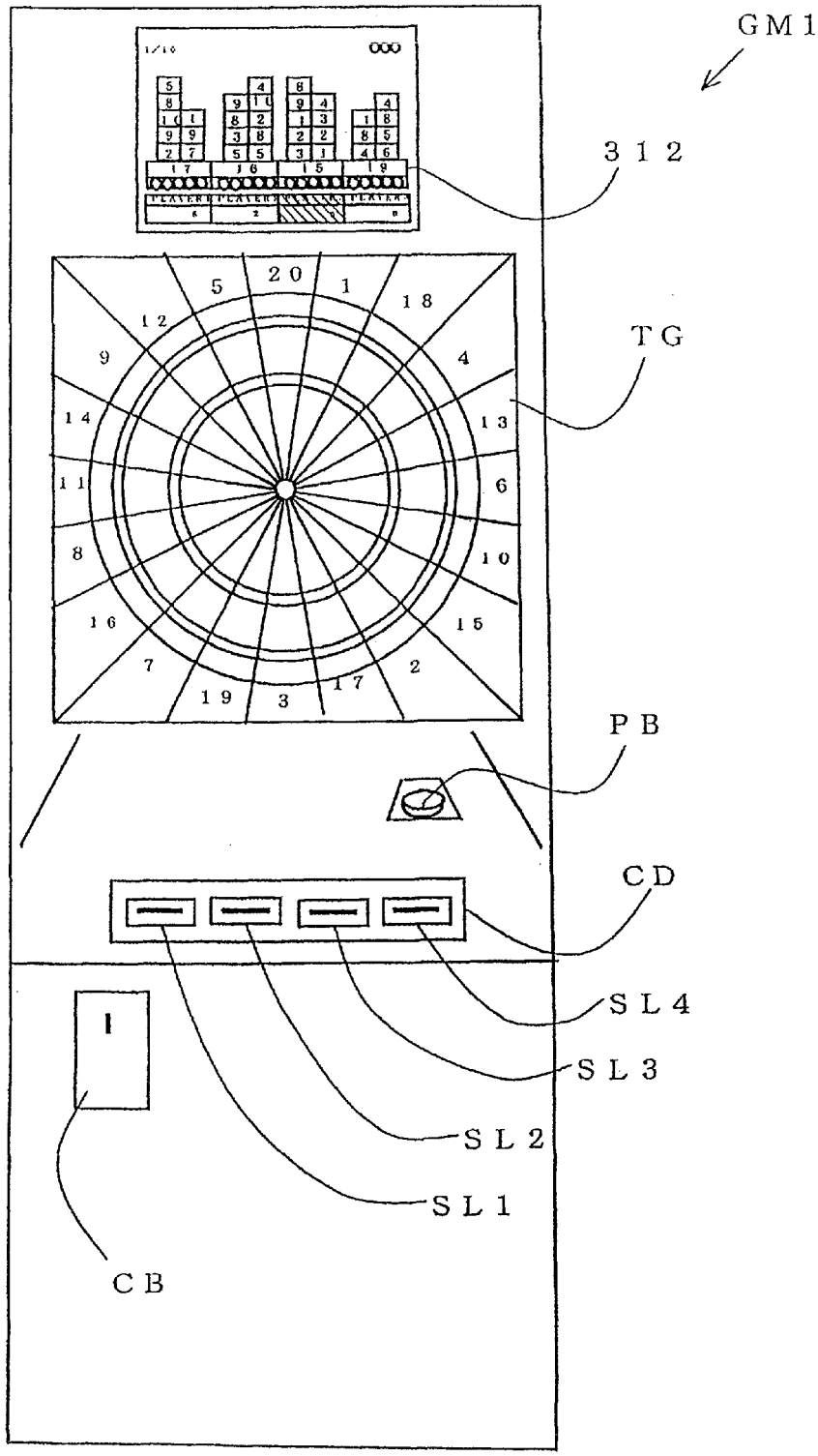
FIG. 2 is an elevation view showing the game machine of FIG. 1.
Figure 3:
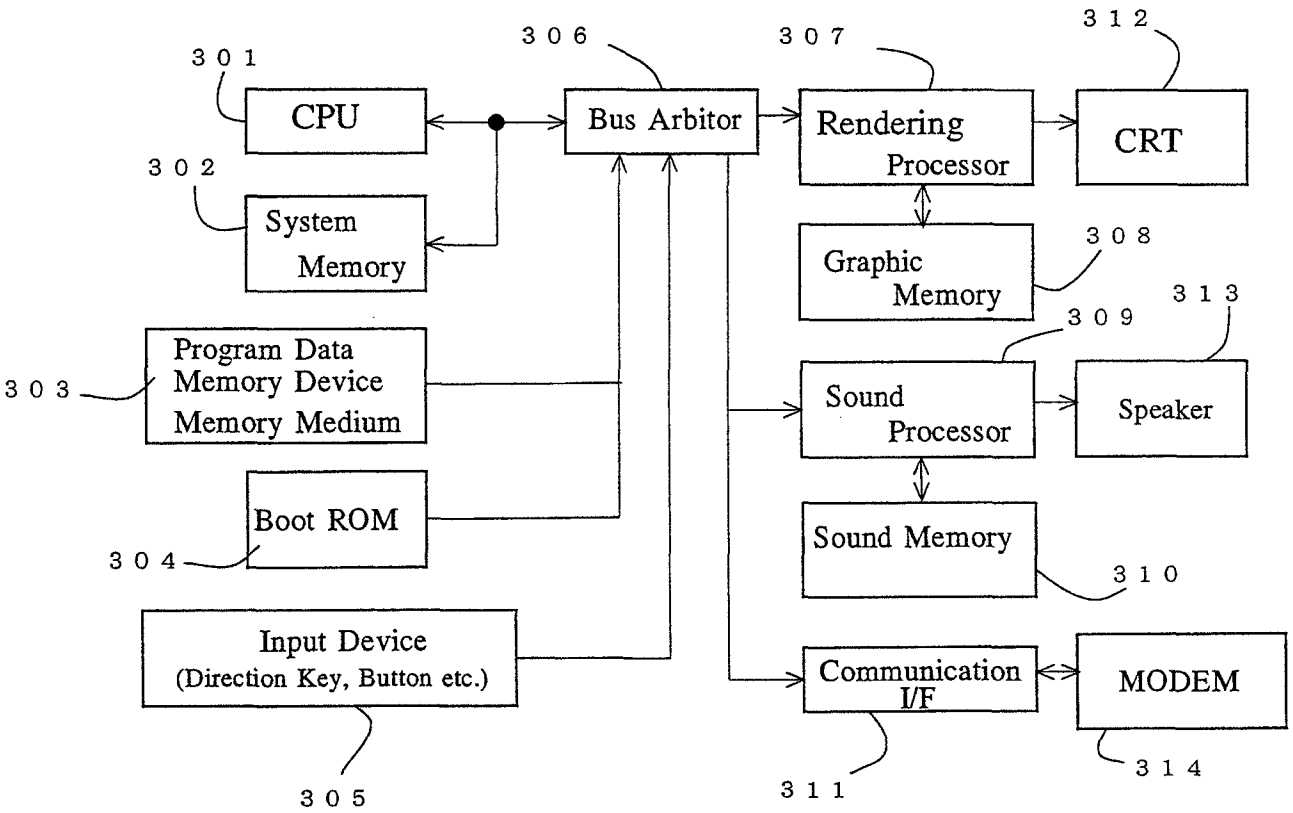
FIG. 3 is a block diagram showing a construction of the game machine in FIG. 1.
Figure 4:
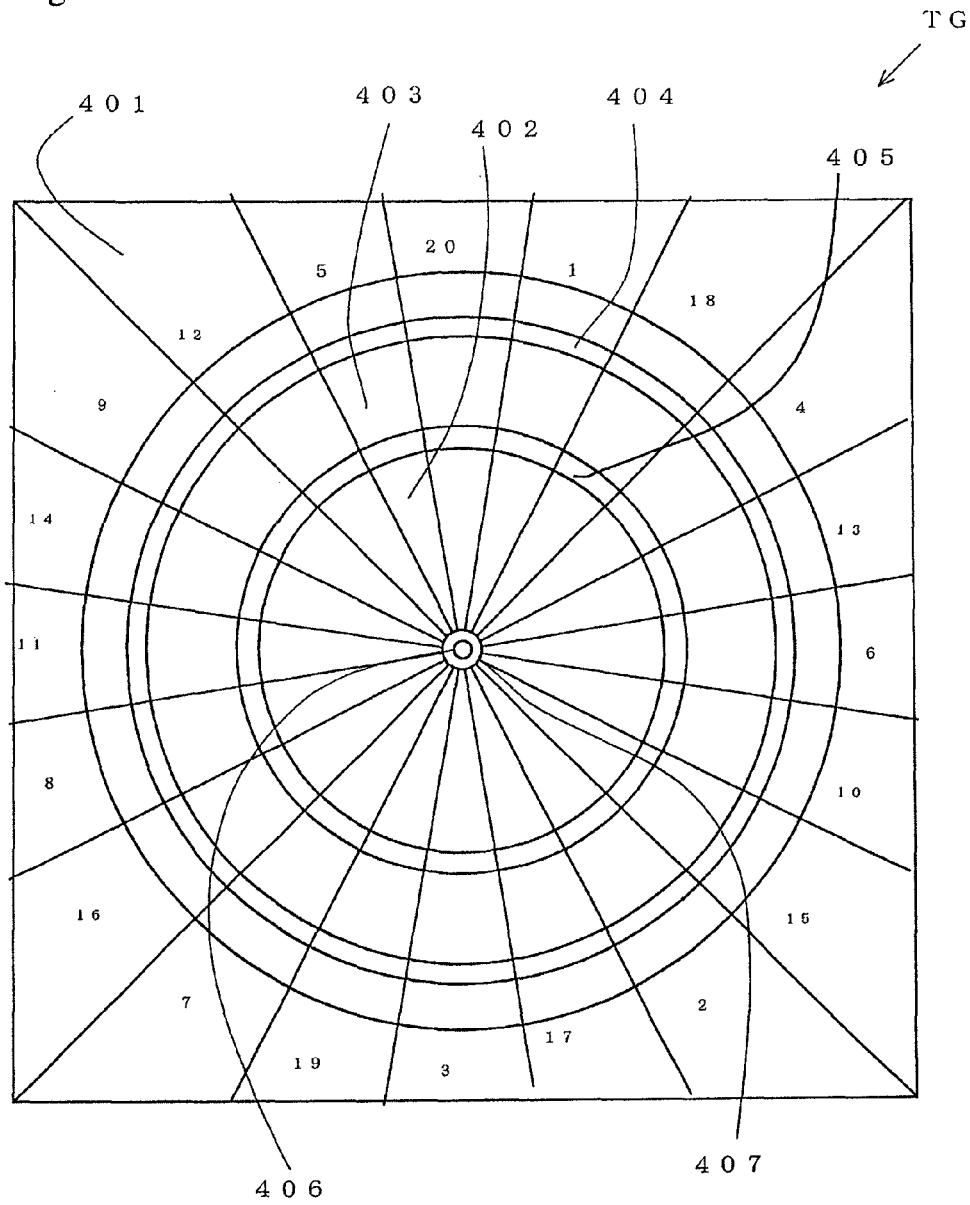
FIG. 4 is an elevation view showing a target of the game machine in FIG. 1.

FIG. 1 is a block diagram showing a network including a game machine according to the present invention, FIG. 2 is an elevation view showing the game machine of FIG. 1, FIG. 3 is a block diagram showing a construction of the game machine in FIG. 1 and FIG. 4 is an elevation view showing a target of the game machine in FIG. 1.

In FIG. 1, a plurality of game machines GM1, GM2, . . . , GMn are connected to a network IN to which a server SV, one or more personal computers PC, a handy phone PH or other communication terminals are connected.

The server SV inputs and outputs various information to and from the game machines GM 1 to GMn connected to the network and controls a game when necessary. Players (not shown) of the game machines GM1 to GMn perform operation and inputting by means of a control unit 1000 included in the game machines GM 1 to GMn for executing the game on the game machines GM 1 to GMn.

The game machine GM 1 is described representatively. The game machine GM 1 includes a target TG of the darts as one of target hitting game, a sensor 101 for detecting area where an arrow (not shown) hit, an encoder 102 for converting an detecting result of the sensor 101 into a numeral data and an interface 103 for inputting a signal of the encoder 102 to a control unit 100.

Therefore, the darts itself or other games adapting the darts can be controlled by the control unit 100.

A card reader CD and a cash-box CB are connected to the control unit 100 so that the control unit 100 detects fee (coin) inserted for executing the game and that the control unit 100 detects an ID card identifying a player so as to obtain the player's own information from the server SV.

The personal computer PC, the handy HP and other communication terminals can obtain various information concerning the game such as statistical result of the game machines GM 1 to GMn, a ranking of the players and event information.

In FIG. 2, the target TG, a CRT 312, the card reader CD and the cash-box CB are provided on the front face of the game machine GM 1. The player inserts the coin and his own ID card into the cash-box CB and the card reader CD, respectively. The card reader CD is provided with a plurality of (for example, 4) slots SL1 to SL4 so that a plurality of players can join the same game. It is also possible that a plurality of cards are inserted into each of the slots SL1 to SL4 for team competition such as "doubles".

The CRT 312 displays information concerning the game and has a function of a game display when a game adopting the darts is executed.

The target TG is not only target hit by the arrow but also a tool by which players obtain points, areas or numerals by arrow throwing.

A button PB is provided on the game machine GM1 for "Player Change" of the darts, which is used as an operation input switch 305 (FIG. 3) for the control unit 100. A Joystick or other input means may be provided in the game machine GM1 as the operation input switch 305.

In FIG. 3, the control unit 100 includes a CPU 301, a boot ROM for storing a program for starting up the control unit 100 and a system memory 302 for storing a program executed by the CPU 301 and data.

The control unit 100 is provided with a rendering processor 307 for generating and for controlling an image to be displayed. A graphic memory 308 is provided in the control unit 100 for storing the generated image and material images for the generated image. The rendering processor 307 displays the generated image on the CRT 312.

Various informations concerning a game executed is displayed on the CRT 312. In the control unit 100, the CPU 301, system memory 302, program data memory medium 303, rendering processor 307 and graphic memory 308 cooperatively perform a function as a display means, for the display of the CRT 312.

A sound processor 309 for generating sound and a sound memory 310 for storing sound to be generated are provided in the control unit 100. The sound processor 309 generates a digital signal of the sound according to the data stored in the sound memory 310 so that the sound is output from a speaker 313 or a headphone (not shown).

A program data memory device or memory medium 303 is provided in the control unit 100. Game programs and data are transfer into the system memory 302, graphic memory 308 and sound memory 310.

The data stored in the memory medium 303 includes information concerning games.

A communication interface 311 and a MODEM 314 are provided in the control unit 100. The control unit 100 is connected through the MODEM 314 to the network IN.

The above components of the control unit 100 are connected to a bus and are arbitrated by a bus arbiter in communication.

A virtual player as subjective player representing the player may be registered in the ID card so that the virtual players play a match against one another.

In FIG. 4, the target TG is a well-known target (darts board) of the darts, which has "bull" area of small circle in the center. The rest area around the bull area is divided along the circumference into 20 equal fan shape areas. Each fan shape area is divided into 4 areas along the radius.

The innermost area 402 of the fan shape area and the third from the area 403 from the area 402 are rather wide area called "single". The second area 405 from the area 402 is a rather narrow area called "triple ring" and the outermost area 404 is a narrow area called "double ring".

The bull area is radially divided into 2 so that 2 inner and outer ring-shaped areas 406 and 407 are shaped. In the bull area, the inner area 406 is called "double bull" or "inner bull" and the outer area 407 is called "single bull" or "outer bull". Generally, the area 406 is of higher point than the area 407.

Basic numerals are allocated to the fan-shape areas, that is, upper most center area is given "20" and the other areas are given "5", "12", "9", "14", "11", "8", "16", "7", "19", "3", "17", "2", "15", "10", "6", "13", "4", "18" and "1" along the circumference in the anticlockwise direction from the area "20". These numerals are shown by a display in the outer area 401. The location of the display is not limited to the area 401 and the location may be the single area etc.

Next, an embodiment showing the total flow of the total games executed in the game machine GM1 to GMn is described.

Game Method

Figure 5:
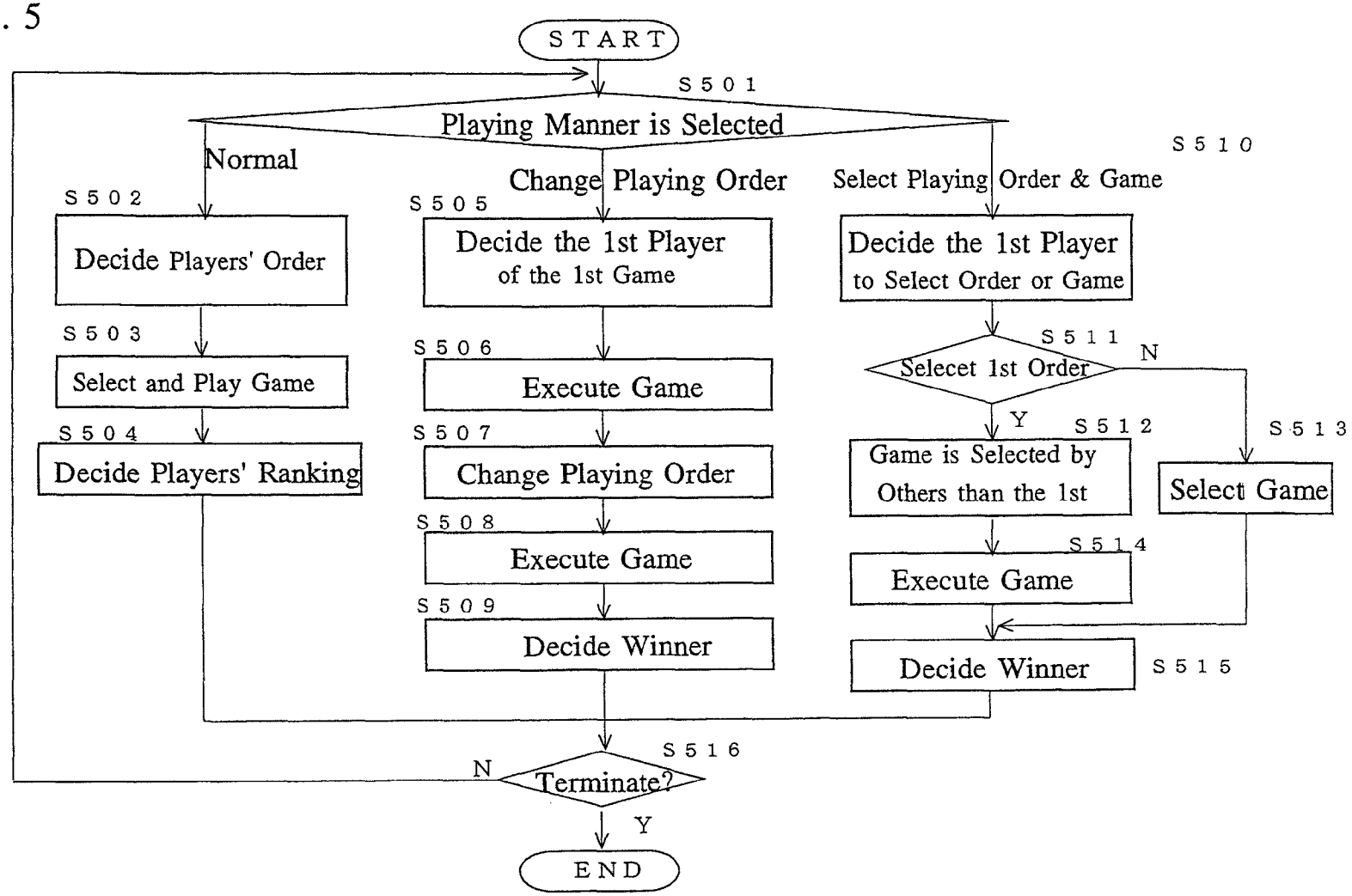
FIG. 5 is a flowchart showing the total flow of a game executed in the game machine of FIG. 1.

FIG. 5 is a flowchart showing the total flow of a game executed in the game machine of FIG. 1.

Step S501: The game method provides a plurality of game manners of "Normal", "Change Playing Order" and "Select Playing Order & Game". The players select one of the manners. Naturally, other types of manners may be provided.

When "Normal", "Change Playing Order" and "Select Playing Order & Game" are respectively selected, the processing is advanced to the Step S502, S505 and S510, respectively.

Step S502: According to the game manner of "Normal", the playing order is determined by some method and the processing is advanced to the Step S503.

Step S503: A game is selected and executed.

Step S504: A players' ranking is decided of the game executed in the step S503.

Step S505: According to the manner of "Change Playing Order", the game is to be executed twice or more times (for example twice). First, the first playing order is decided by some method.

Step S506: The first game is executed. Then the processing is advanced to the Step 507.

Step S507: The playing order is changed. Then, the processing is advanced to the step S508. When the players' order is manually changed, it is necessary to insert the ID cards into the card reader in the new playing order, after the players are identified by the ID cards. While, when the "Change Playing Order" is selected, the playing order is automatically changed and the ID cards order change is unnecessary. Since the first player is usually advantageous in the darts, the playing order change is highly needed. In the step of automatic playing order change, the playing order of the first game is changed in the next game. However, it is also possible that the players' ranking is decided for the first game and the loser becomes first player of the next game according to the first ranking. Then, the winner is automatically handicapped.

Step S508: The next game is executed and processing is advanced to the Step 509.

Step S509: The players' ranking is decided of the game executed in the step S508.

Step S510: According to the manner of "Select Playing Order & Game", either the game selection or the playing order selection is selected. First, the first determining player is determined by some method and the processing is advanced to the step S511.

Step S511: The first determining player selects either the game kind selection or the first order. When the first determining player selects the first order, the processing is advanced to the step S512, and when the game kind is selected, the processing is advanced to the step S513.

Step S512: When the first determining player selects the first order, the other (second order) player selects the game kind and the processing is advanced to the step S514.

Step S513: When the first player selects the game kind, the player selects a game and the processing is advanced to the step S514.

Step S514: The selected game is executed and the processing is advanced to the step S515.

Step S515: The players' ranking is determined of the game executed in the step S514.

Step S516: Following to the steps S504, S509 and S515, it is determined whether the game is terminated or not. When the game is to be terminated, the processing is terminated, and when continued, the processing is returned back to the step S501.

According to the above game method, a plurality of (for example 7) games can be executed. Next, a game method of each game is described.

1st Game "SURVIVOR"

Figure 6:
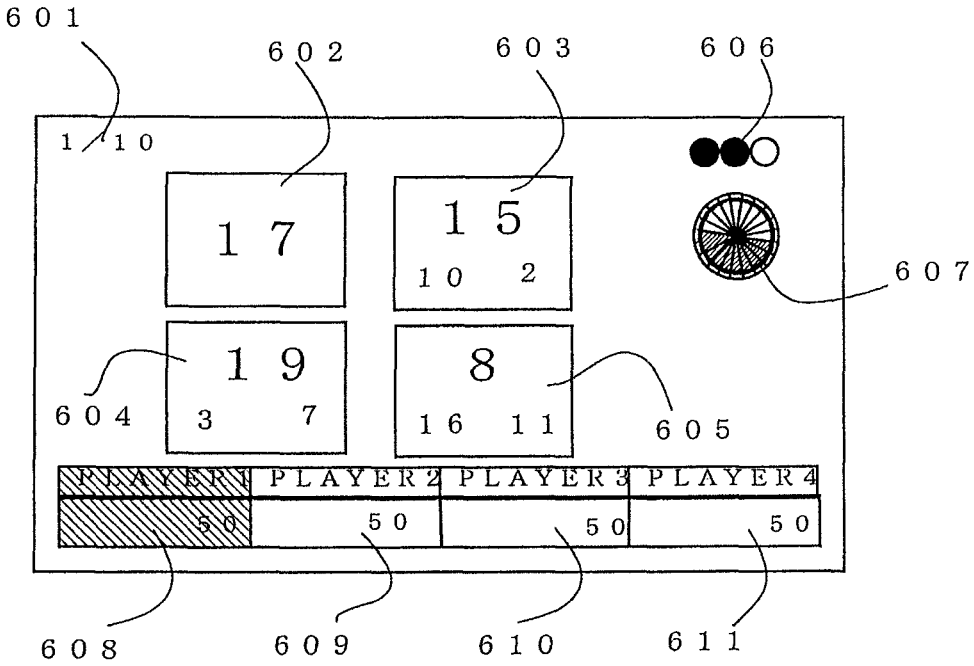
FIG. 6 shows a display image (displayed on the CRT 312) of the first game (named "SURVIVOR") executed in the game machines GM1 to GMn.
Figure 13:
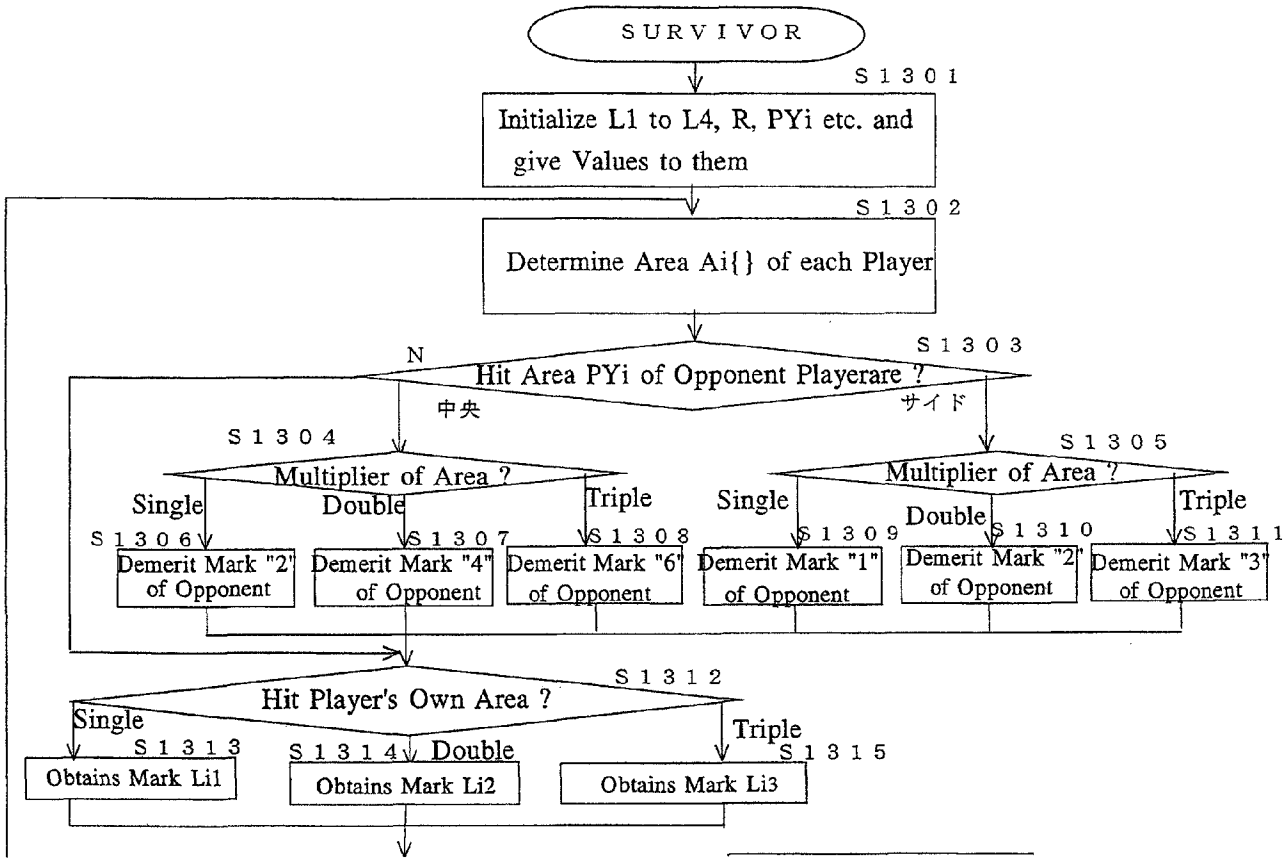
FIG. 13 is a flowchart showing the processing of the first game.

FIG. 6 shows a display image (displayed on the CRT 312) of the first game (named "SURVIVOR") executed in the game machines GM1 to GMn. FIG. 13 is a flowchart showing the processing of the first game.

In FIG. 6, 4 players (or 4 teams of players) can be join the first game. Each player tries to get the fan-shaped area of the target TG in each turn (called "round").

In the display image, display boxes 602, 603, 604 and 605 are displayed for indicating the areas obtained by the players. In the display box 602, a number "17" is shown for identifying the first player's area. In the display box 603, numbers "10", "15" and "2" identifying the second player's area are shown. In the display box 604, numbers "3", "19" and "7" identifying the third player's area are shown. In the display box 605, numbers "16", "8" and "11" identifying the fourth player's area are shown. The plural numbers in one display box are neighboring and successive three areas in the target TG. In the display image, other display boxes 608, 609, 510 and 611 are shown for identifying players' points (called "life Li").

In the display image, there are shown a display 601 indicating the current round and the total rounds (In the figure, 1/10 means the first round among the ten rounds.), a display 606 indicating the finished arrows of the current player in the current round, and a display 607 imitating the target for indicating areas obtained by each player. The display 606 has circles of number of three meaning the total arrow throwing in one round, and circles corresponding to the finished throw are changed in color, for example. In the display 607, players' areas are distinguished by different colors.

In FIG. 13, the first game is executed through the following steps.

Step S1301: The life Li, current round R, current player PYi etc. are initialized and values are given to them. The total number of players is judged by number of ID cards inserted into the card reader CD.

For initializing the Life Li etc., the CPU 301, system memory 302, program data memory medium 303 of the control unit 100 cooperatively perform a function as an initializing means.

Step S1302: Next to the step S1301, the players' areas Ai{ } in each round are set and the each player throws the arrows.

Step S1303: Next to the step S1302, the area in the target TG is detected where the arrow hits, and it is judged whether the hit area is the opponent player's PYj (other players' than the current player) or not. If the area is not the opponent's PYj, the processing is jumped to the step S1306. If the opponent's PYj, it is judged whether the area is the center or side area among the three neighboring area. Among the neighboring three areas "10", "15" and "2", the area "15" is the center and the areas "10" and "2" are the side. When a player possesses just one area, the area is handled as the center.

When the center, the processing is advanced to the step S1304, and when the side, the processing is advanced to the step S1305.

Step S1304: It is judged which area of single, double, triple or bull is hit by the arrow. When single, the processing is advanced to the step S1306, when double, advanced to the step S1307 and when triple, advanced to the step S1308.

Step S1305: It is judged which area is hit of "single", "double" or "triple" by the arrow. When single, the processing is advanced to the step S1309, when double, advanced to the step S1310 and when triple, advanced to the step S1311.

Step S1306: Point 2 is subtracted from the life Li of the current player, and the processing is advanced to the step S1312.

Step S1307: Point 4 is subtracted from the life Li of the current player, and the processing is advanced to the step S1312.

Step S1308: Point 6 is subtracted from the life Li of the current player, and the processing is advanced to the step S1312.

For subtraction of the Life Li, the CPU 301, system memory 302, program data memory medium 303 of the control unit 100 cooperatively perform a function as a subtracting means.

Step S1309: Point 1 is subtracted from the life Li of the current player, and the processing is advanced to the step S1312.

Step S1310: Point 2 is subtracted from the life Li of the current player, and the processing is advanced to the step S1312.

Step S1311: Point 3 is subtracted from the life Li of the current player, and the processing is advanced to the step S1312.

Step S1312: It is judged whether the hit area is the player's PYi (The players currently throwing the arrow.) or not. If the area is not the player's PYi, the processing is jumped to the step S1316. If the player's PYi, it is judged which of "single", "double" or "triple" the area is.

When single, the processing is advanced to the step S1313, when double, advanced to the step S1314 and when triple, advanced to the step S1315.

Step S1313: Point 1 is added to the life Li of the current player PYi, and the processing is advanced to the step S1316.

For addition of the Life Li, the CPU 301, system memory 302, program data memory medium 303 of the control unit 100 cooperatively perform a function as an adding means.

Step S1314: Point 2 is added to the life Li of the current player PYi, and the processing is advanced to the step S1316.

Step S1315: Point 3 is added to the life Li of the current player PYi, and the processing is advanced to the step S1316.

Step S1316: If there is an opponent whose life Li becomes zero by the processing of the steps S1306 to S1311, the processing is advanced to the step S1317, otherwise, the processing is advanced to the step S1318.

Step S1317: The opponent of the life Li of zero is deleted and the step is advanced to the step S1318.

For eliminating players, the CPU 301, system memory 302, program data memory medium 303 of the control unit 100 cooperatively perform a function as an eliminating means.

Step S1318: When one player remains by the processing of the step S1317, the game is finished. Then, the processing is jumped to the step S1324.

Step S1319: When it is judged that two or more players remain in the step S1318, then it is judged whether the current player has finished the arrow throwing or not. Each player pushes the player change button PB on finishing the three times arrow throwing of one round. Then, the game machine GM1 detects that the three times arrow throwing has been finished.

If the player is to be changed, the processing is advanced to the step S1320, otherwise, returned to the step S1302.

Step S1320: It is judged whether all the players have finished the arrow throwing of the current round or not, that is, whether the game is to be advanced to the next round or not. When to be advanced to the next round, the processing is advanced to the step S1322 and when the round is not finished, the processing is advanced to the step S1321.

Step S1321: The player to throw the arrows is changed to the player of the next turn and the processing is advanced to the step S1302.

Step S1322: It is judged whether the current round reaches the final round Rmax (round limit) or not. If the current round reaches Rmax, the processing is advanced to the step S1322, otherwise, the processing is advanced to the step S1323.

Step S1323: The player to throw the arrow is returned to the first player and the processing is returned to the step S1302.

Step S1324: The game is judged to be terminated, the players' ranking is shown and the processing is terminated.

The first game makes even a beginner easily join and is highly entertaining since neighboring targets (areas) of a predetermined range are aimed at adopting the target hitting game.

The areas in the target TG are get by a player as well as by opponents, and one same area may be set for a player and a opponent. Therefore, the game is interesting from high strategy, active as well as dynamic point of view.

$2^{nd}$ Game "SPLAT181"

Figure 7A:
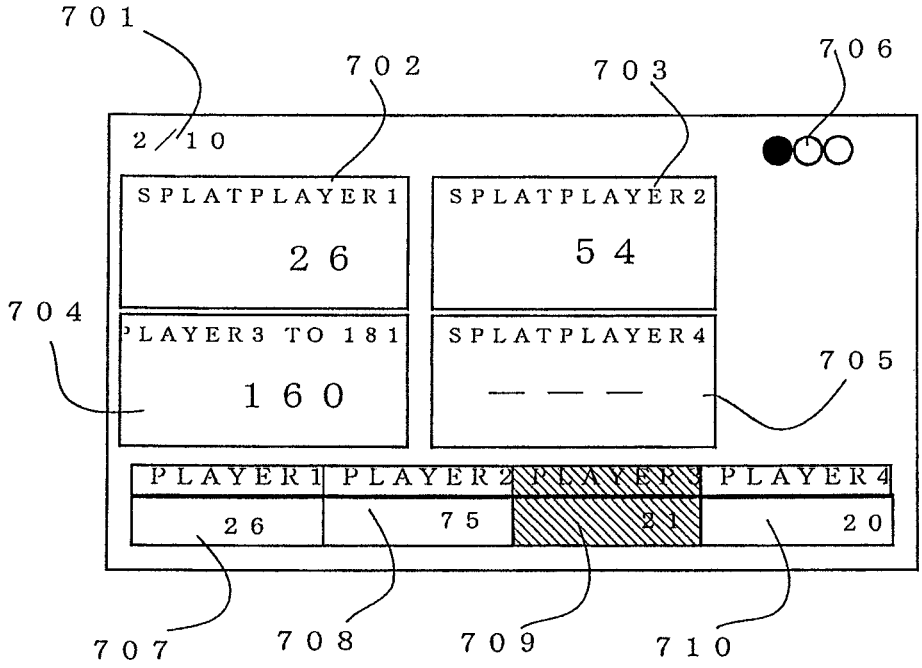
FIG. 7A shows a display image of the second game executed in the game machines GM1 to GMn.
Figure 7B:
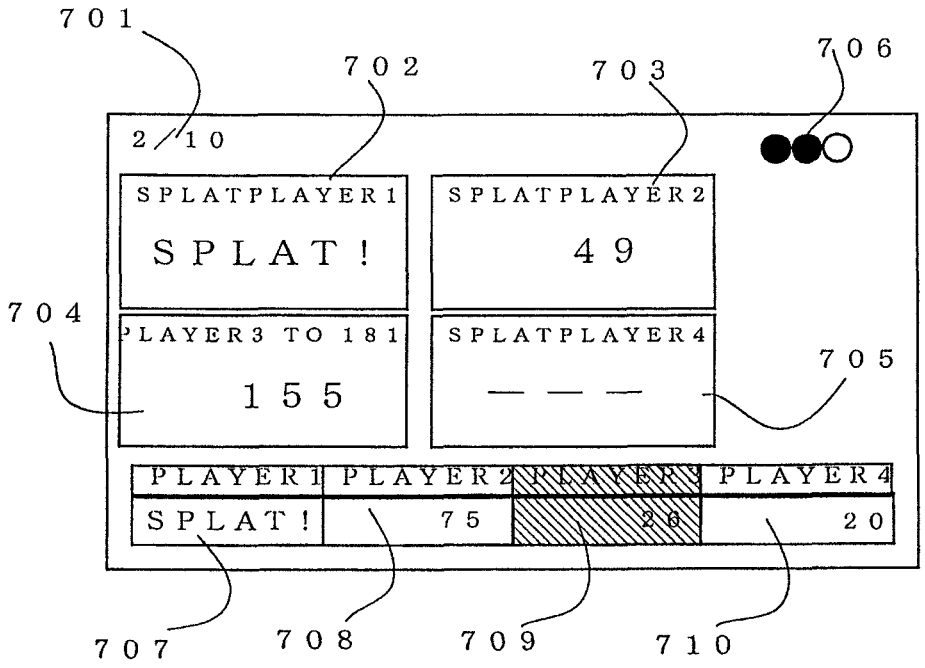
FIG. 7B shows another display image of the second game executed in the game machines GM1 to GMn.
Figure 14:
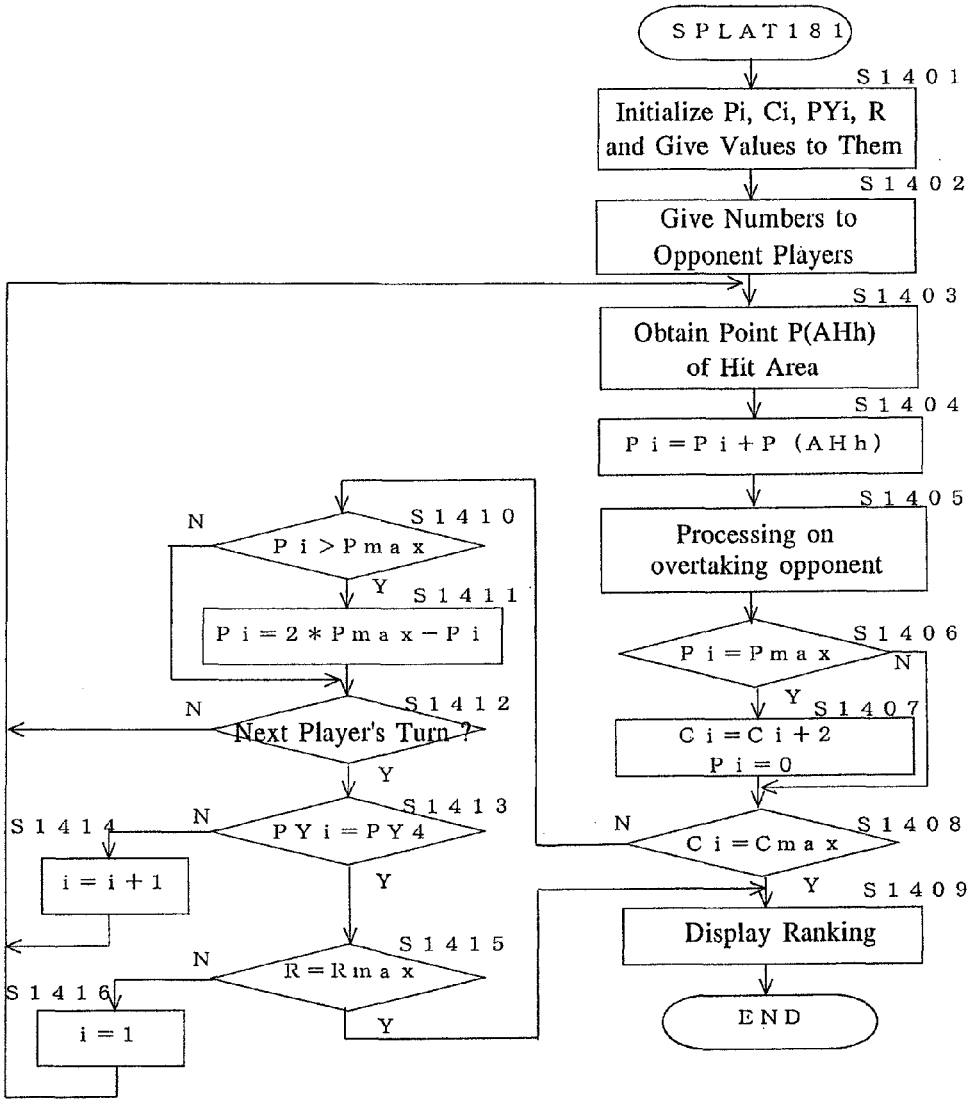
FIG. 14 is a flowchart showing the processing of the second game.
Figure 15:
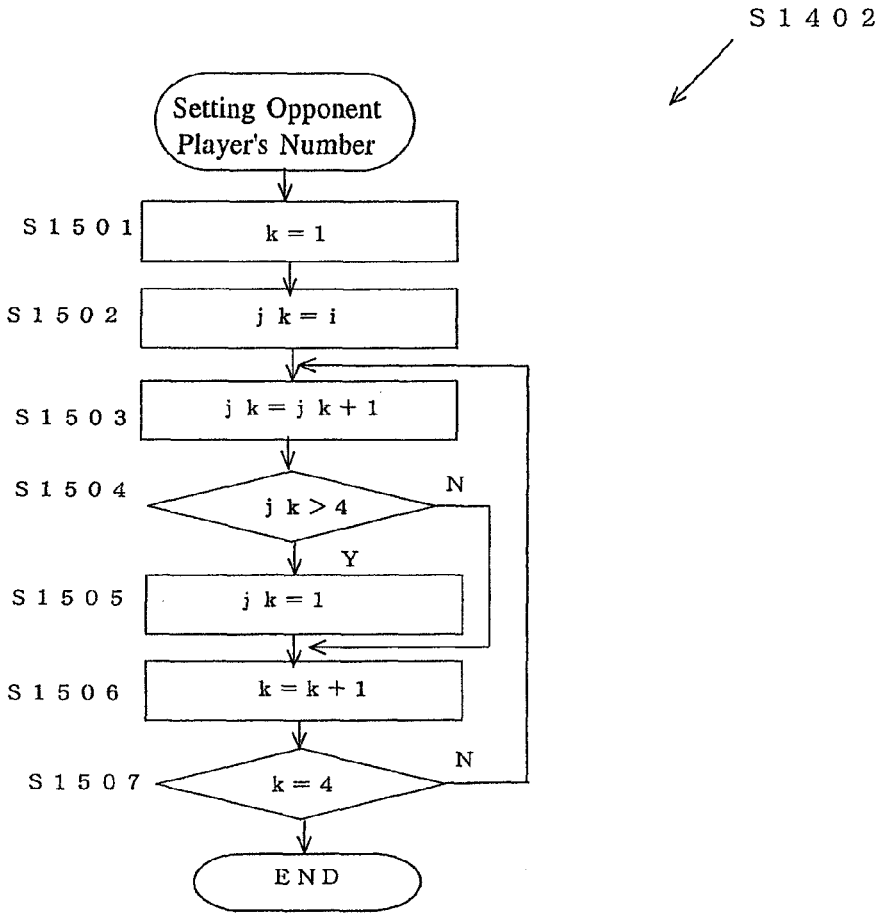
FIG. 15 is a flowchart showing the processing for giving numbers to opponent players.
Figure 16:
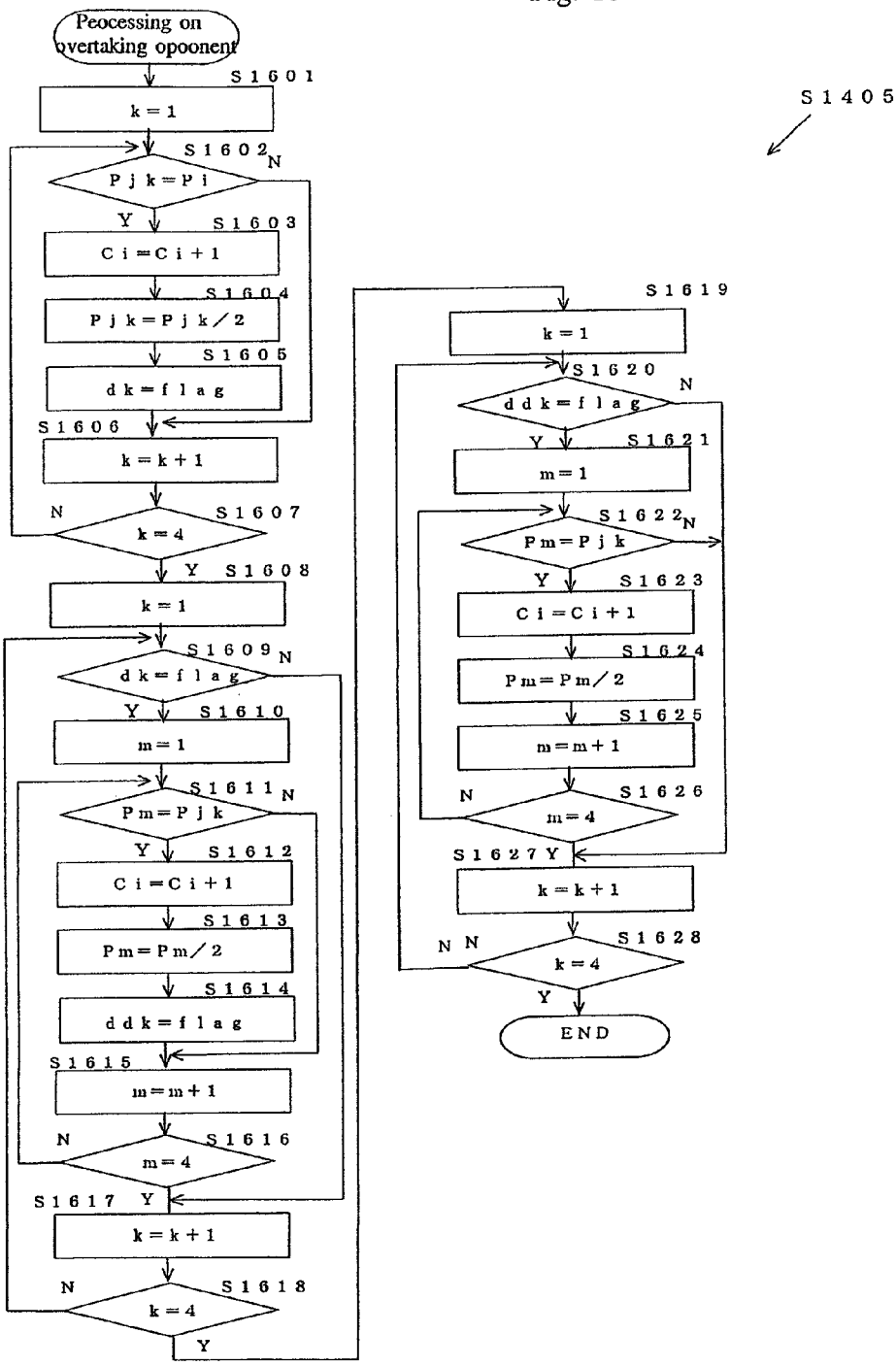
FIG. 16 is a flowchart showing the processing when a player overtakes an opponent.

FIG. 7A and FIG. 7B show display image (displayed on the CRT 312) of the second game (named "SPLAT181") executed in the game machines GM1 to GMn. FIG. 14 is a flowchart showing the processing of the second game. FIG. 15 is a flowchart showing the processing for giving numbers to opponent players and FIG. 16 is a flowchart showing the processing when a player overtakes an opponent.

In FIG. 7A, 4 players (or 4 teams of players) can be join the second game. Each player gets a point of an area hit by the arrow. The total point of each player is limited by an upper limit "181" so that the total point recurs between "0" and "181". For example, when the total point of a player overtakes a total point of an opponent, the player gets virtual coins as game money. Each player competes with other plays for the number of virtual coins the player gets.

In the display image, display boxes 707, 708, 709 and 710 are displayed for indicating the total points obtained by the players. In the display boxes 707, 708, 709 and 710, the first player's total point "26", the second player's total point "75", the third player's total point "21" and the fifth player's total point "20" are shown, respectively.

In the display image, display boxes 702, 703, 704 and 705 are further shown for displaying relative points, which correspond the first, second, third and fourth player, respectively. In the display box 704 of the current player (the third player), there are shown the difference "160" between the maximum point "181" and the current point, and a title "PLAYER3 TO 181" showing the number is the difference.

As for the display boxes corresponding to other players than the current player, only in the display boxes of the higher points than the current player's, the point difference from the current player's to the others'. In FIG. 7A, the point difference "54" is shown in the display box 703 because the second player's point is higher than the third player's point.

If the third player gets point "5" by the arrow throwing, his total point becomes "26", overtaking the first player's total point. Then, a message "SPLAT!" is shown in the display boxes 702 and 707 meaning that the player is overtaken by an opponent as shown in FIG. 7B. The player overtaken by the opponent is given a demerit mark that the total point is decreased to be half. After the display of "SPLAT!", the decreased point "13" (not shown) is displayed.

In the display image, there are shown a display 701 indicating the current round and the total rounds (In FIGS. 7A and 7B, the second round among the ten rounds.), a display 706 indicating the finished arrows of the current player in the current round. The display 706 has white circles of number of three meaning the total arrow throwing in one round, and circles corresponding to the finished throw are changed to be black, for example.

In FIG. 14, the second game is executed through the following steps.

Step S1401: The point Pi, current round number R, player number PYi, number of coins Ci etc. are initialized and values are given to them. The total number of players is judged by a number of ID cards inserted into the card reader CD.

Step S1402: Next to the step S101, numbers of opponent players (other players than the current player throwing the arrows, hereafter) are set. When a player's point overtakes another player's point, the player gets a coin and the opponent loses points in the second game. The numbers are indicators set for identifying opponent when the player starts game. The processing of the opponents' number is described in detail referring to FIG. 15.

Here, the player throws the arrow toward the target.

Step S1403: Next to the step S1402, Next to the step S1402, the area (AHh, hereafter) in the target TG hit by the arrow is detected and the player gets a point P(AHh) of the area.

Step S1404: The point P(AHh) I added to the point Pi of the player PYi and the processing is advanced to the step S1405.

For addition of the point Pi, the CPU 301, system memory 302, program data memory medium 303 of the control unit 100 cooperatively perform a function as an adding means.

Step S1405: If the point Pi overtakes an opponent's point, the "processing on overtaking opponent" of FIG. 16 is executed.

For judging whether the point Pi overtakes opponent's point Pj, the CPU 301, system memory 302, program data memory medium 303 of the control unit 100 cooperatively perform a function as a judging means.

Step S1406: It is judged whether the player's pint Pi reaches the maximum point Pmax (=181) or not. If Pi=Pmax, the processing is advanced to the step S14078, otherwise, the processing is jumped to the step S1408.

Step S1407: When Pi=Pmax, number Ci of coins is increased by two and the point Pi is returned to "0".

The number of coins Ci can be defined as the second point following to the point Pi. For giving the coin to the players, the CPU 301, system memory 302, program data memory medium 303 of the control unit 100 cooperatively perform a function as a second point giving means. While, for the processing of restoring the point Pi to zero, the CPU 301, system memory 302, program data memory medium 303 of the control unit 100 cooperatively perform a function as a first point restoring means.

Step S1408: It is judged whether the number of coins Ci reaches a predetermined maximum Cmax (for example 7) due to coins obtained in the step S1407 or not. When Ci=Cmax, the processing is advanced to the step S1409, otherwise, the processing is advanced to the step S1410.

Step S1409: It judged that the game is to be terminated and the processing is terminated.

Step S1410: It is judged whether the point Pi exceeds Pmax or not. If Pi>Pmax, the processing is advanced to the step S1411, other, the processing is advanced to the step S1412.

Step S1411: The point Pi is decreased by a surplus point Pi higher than Pmax, that is, Pi=2*Pmax−Pi is calculated.

For the subtraction of the point Pi, the CPU 301, system memory 302, program data memory medium 303 of the control unit 100 cooperatively perform a function as a subtracting means.

Step S1412: It is judged whether the current player has finished the arrow throwing or not. Each player pushes the player change button PB on finishing the three times arrow throwing of one round. Then, the game machine GM1 detects that the three times arrow throwing has been finished. If the player is to be changed, the processing is advanced to the step S1413, otherwise, returned to the step S1403.

Step S1413: It is judged whether all the players have finished the arrow throwing of the current round or not, that is, whether the game is to be advanced to the next round or not. When to be advanced to the next round, the processing is advanced to the step S1415 and when the round is not finished, the processing is advanced to the step S1414.

Step S1414: The player to throw the arrows is changed to the player of the next turn and the processing is advanced to the step S1403.

Step S1415: It is judged whether the current round reaches the final round Rmax (round limit) or not. If the current round reaches Rmax, the processing is advanced to the step S1409, otherwise, the processing is advanced to the step S1416.

Step S1416: The player to throw the arrow is returned to the first player and the processing is returned to the step S1403.

In FIG. 15, the processing of the step S1402 is executed through the following steps.

Step S1501: A counter k is initialized to "1" for setting the number jk of the opponent players.

Step S1502: In order to set jk starting from the number "i" of the player PYi, jk is substituted by "i" first processing of this step.

Step S1503: "1" is added to jk. At first, a number next to "i" is the first opponent number, and the opponent number is advanced by "1" on every recurrent processing of this step.

Step S1504: It is judged whether jk exceeds the final number (assuming the total number of players is 4) or not. Since, If "i" is not "1", the opponent number is returned to "1" halfway, the processing is advanced to the step S1505 when jk reach the final number. When jk does not exceeds the final number, the processing is jumped to the step S1506.

Step S1505: jk is returned to "1".

Step S1506: K is increased by "1".

Step S1507: It is judged whether k exceeds the maximum or not, that is, whether all opponents PYj (j is not i) are given the opponent number or not. If the opponent numbers are given to all the opponents, the processing is terminated, otherwise, the processing is returned to the step S1503.

In FIG. 16, the processing of the step S1405 is executed through the following steps.

Step S1601: First, the counter k is initialized to "1" for successively searching an opponent whose point is equal to the player' point.

Step S1502: It is judged whether a point Pjk of an opponent PYjk is equal to the player's pint Pi or not. If equal, the processing is advanced to the step S1603, otherwise, the step is jumped to the step S1606.

Step S1603: If Pjk=Pi in the step S1602, that is, the point of the player PYi overtakes the point of PYj, the number Ci of coins is increased by "1".

Step S1604: The point Pjk of opponent PYjk is decreased to half because the opponent PYjk is overtaken by the player PYj.

For the subtraction of the point Pi, the CPU 301, system memory 302, program data memory medium 303 of the control unit 100 cooperatively perform a function as a subtracting means.

Step S1605: The point Pjk of the opponent PYjk may due to decrement be equal to another opponent's point. In this case, the other opponent's point is also decreased. For this processing, a point decrement flag "flag" is registered in the number "dk" of the overtaken opponent.

Step S1607: The counter k is increased by "1".

Step S1607: It is judged whether k exceeds the maximum by the step S1605 or not, that is, whether the player's point has been compared with the points of all the opponents PYjk (jk is not i) or not. If the comparison has been completed, the processing is advanced to the step S1606, otherwise, the processing is returned to the step S1602.

Step S1608: In order to search whether a opponent's decreased point becomes equal to another opponent's point or not, the counter k is initialized to "1" first.

Step S1609: It is judged whether "dk" is substituted by "flag" or not. If substituted, the processing is advanced to the step S1612, otherwise, the processing is jumped to the step S1615.

Step S1610: A counter "m" is initialized to "1" of other opponents than PYjk to be compared with the opponent PYjk.

Step S1611: It is judged whether the point Pjk of the opponent PYjk is equal to the point Pm of another opponent PYm or not. If equal, the processing is advanced to the step S1612, otherwise, the processing is jumped to the step S1615.

Step S1612: If Pm=Pjk in the step S1611, that is, the point of the opponent PYjk is decreased to the point Pm, the number Ci of the coins of the player PYi is increased by "1".

Step S1613: The point Pm of the opponent PYm is decreased to half because the point of the opponent PYjk is equal to Pm.

Step S1614: The point Pm of the opponent PYm may due to decrement be equal to further another opponent's point. In this case, the second other opponent's point is also decreased. For this processing, a point decrement flag "flag" is registered in the number "ddk" of the second overtaken opponent.

Step S1615: The counter m is increased by "1".

Step S1616: It is judged whether the process result m of the step S1605 exceeds the maximum or not, that is, the comparison with all the opponents is completed or not. If the comparison is completed, the step is advanced to the step S1617, otherwise, the step is returned to the step S1611.

Step S1617: The counter k is increased by "1".

Step S1618: It is judged whether the process result k of the step S1605 exceeds the maximum or not, that is, the comparison with all the opponents PYjk is completed or not. If the comparison is completed, the step is advanced to the step S1619, otherwise, the processing is returned to the step S1609.

Step S1619: In order to judge whether the decreased point in the steps S1609 to S1618 of the opponent PYm becomes equal to another opponent's point or not, the counter k is initialized to "1", first.

Step S1620: It is judged whether the number "ddk" of the other opponent is substituted by "flag" or not. If substituted, the processing is advanced to the step S1620, otherwise, the processing is jumped to the step S1627.

Step S1621: The counter "m" is initialized to "1" of other opponents than PYjk to be compared with the opponent PYjk.

Step S1622: It is judged whether the point Pjk of the opponent PYjk is equal to the point Pm of another opponent PYm or not. If equal, the processing is advanced to the step S1621, otherwise, the processing is jumped to the step S1627.

Step S1623: If Pm=Pjk in the step S1622, that is, the point of the opponent PYjk is decreased to the point Pm, the number Ci of the coins of the player PYi is increased by "1".

Step S1624: The point Pm of the opponent PYm is decreased to half because the point of the opponent PYjk is equal to Pm. If the number of the players is four at most, the point coincidence of decreased point of the fourth stage with another opponents' point never occurs. Therefore, the flag of the third stage coincidence is not set.

Step S1625: The counter m is increased by "1".

Step S1626: It is judged whether the process result m of the step S1605 exceeds the maximum or not, that is, the comparison with all the opponents is completed or not. If the comparison is completed, the step is advanced to the step S1627, otherwise, the step is returned to the step S1622.

Step S1627: The counter k is increased by "1".

Step S1628: It is judged whether the process result k of the step S1605 exceeds the maximum or not, that is, the comparison with all the opponents PYjk is completed or not. If the comparison is completed, the processing is terminated, otherwise, the processing is returned to the step S1620.

The second game makes even a beginner easily join and is highly entertaining since not only high but also accurate point is preferable.

Further, the circulation of the points is analogous to a competition around a circulated track. The possibility of coincidence of the points is high due to circulated points and a lot of coin may be obtained by one arrow throw. Therefore, active and dynamic interest is excited.

3$^{rd}$ Game "PIZZAREA"

Figure 8:
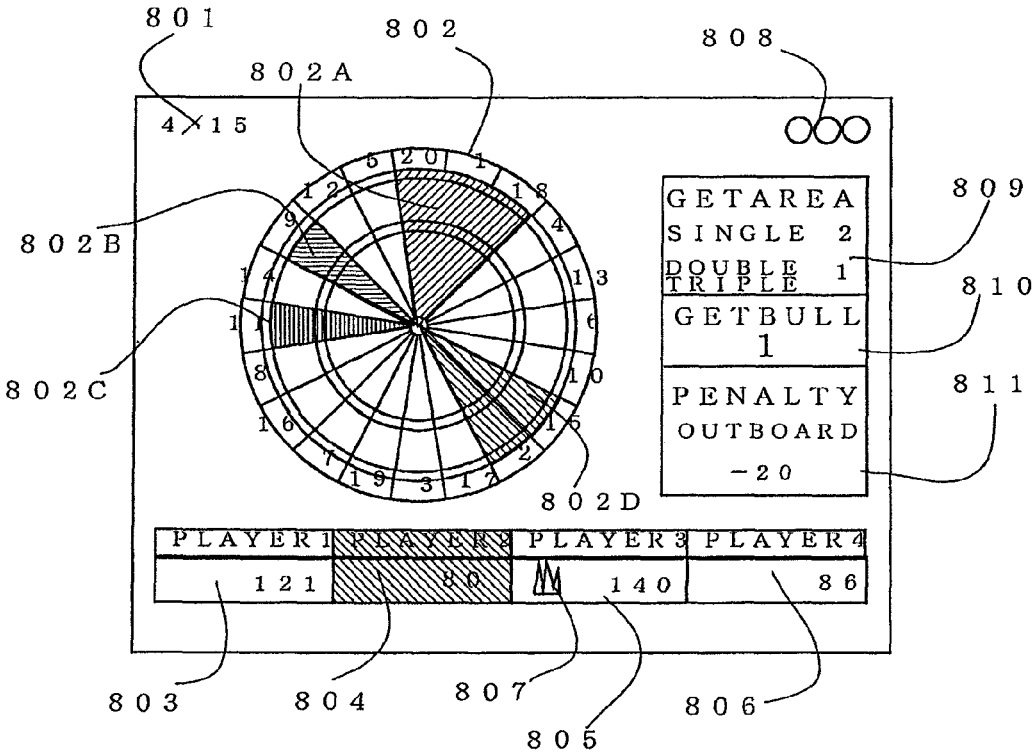
FIG. 8 shows a display image of the third game executed in the game machines GM1 to GMn.
Figure 17:
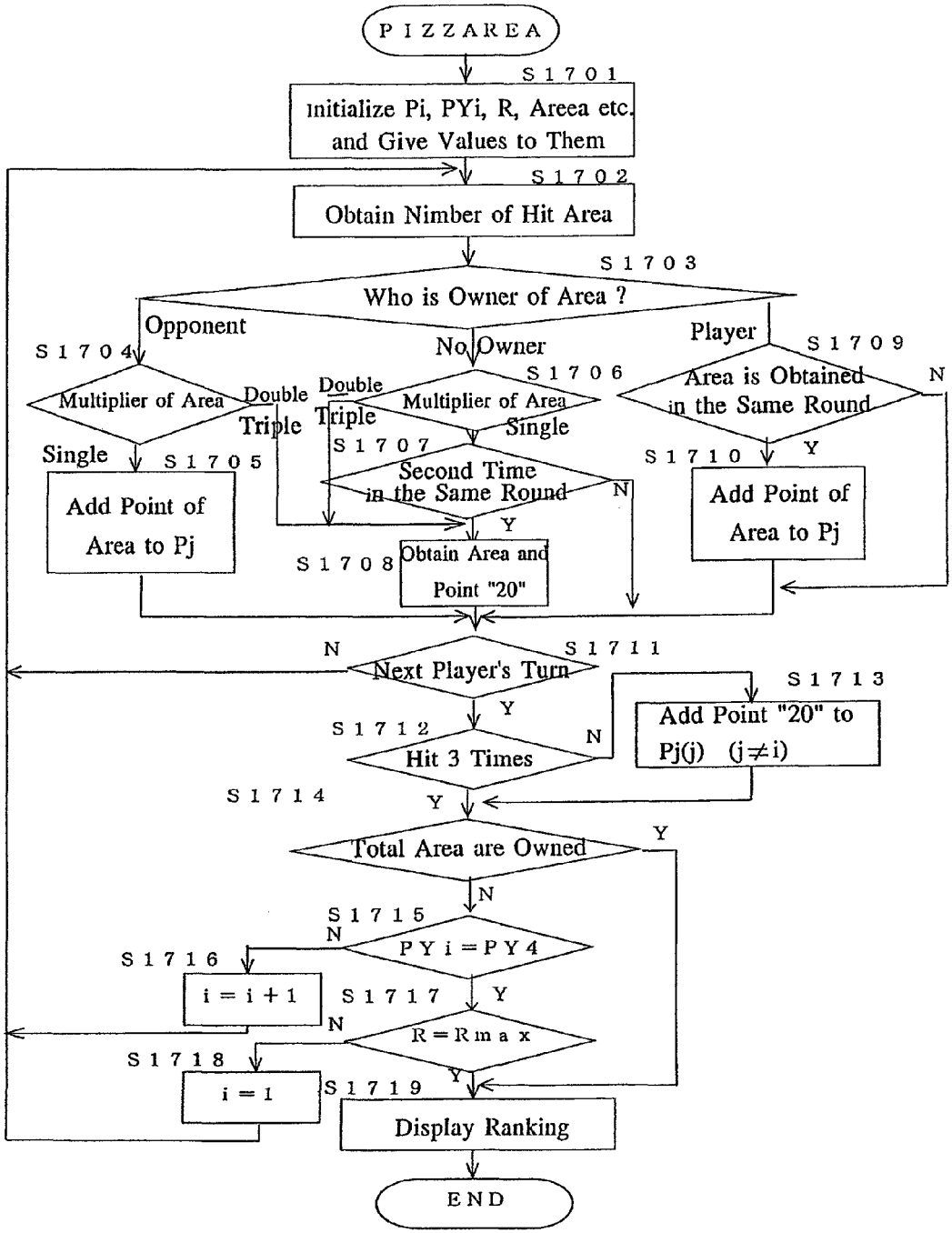
FIG. 17 is a flowchart showing the processing of the first game.

FIG. 8 shows a display image (displayed on the CRT 312) of the third game (named "PIZZAREA") executed in the game machines GM1 to GMn. FIG. 17 is a flowchart showing the processing of the first game.

In FIG. 8, 4 players (or 4 teams of players) can be join the third game. Each player tries to get the fan-shaped areas of the target TG and points corresponding to the hit areas.

A display area 802 analogous to the target TG may be shown in the display image in which areas 802A, 802B, 802C and 802D obtained by the players are distinguished by different colors. The players will highly interested in the game and the distinction is convenient for strategic planning.

In the display image, display boxes 803, 804, 805 and 806 are displayed for indicating the players' points. In the display boxes 803, 804, 805 and 806, points "121", "80", "140" and "86" of the first, second third and fourth player's are shown, respectively. One of the display boxes is colored by a predetermined color for indicating the current player (the second player in FIG. 8) throwing the arrow. In the display box of the highest point (the third player in FIG. 8), a mark 807 is shown.

In the display image, there are shown a display 801 indicating the current round and the total rounds (In the figure, 4/15 means the fifth round among the fifteen rounds.), a display 808 indicating the finished arrows of the current player in the current round, and a display 809 to 811 describing the game rule briefly. The display 808 has circles of number of three meaning the total arrow throwing in one round, and circles corresponding to arrows hit onto the target are changed in color.

In the display box 809, a point of "2" corresponding to the "single" area and "1" corresponding to the "double" or "triple" area. In the display box 810, a point of "1" when the arrow hit the "bull" area. In the display box 811, a penalty "−20" when the arrow is outboard.

In FIG. 17, the third game is executed through the following steps.

Step S1701: The point Pi, current round R, current player PYi, obtained area etc. are initialized and values are given to them. The total number of players is judged by number of ID cards inserted into the card reader CD.

Step S1702: Next to the step S1701, the area in the target TG where the arrow hit is detected and a number of the area is obtained.

Step S1703: Next to the step S1702, it is judged which of a area of the current player PYi (the player throwing the arrows), opponent's area or ownerless, the hit area is. When the area is player's (PYi), the processing is advanced to the step S1709, when opponent's, the processing is advanced to the step S1704 and when ownerless, the processing is advanced to the step S1706.

Step S1704: When the hit area of the opponent PYj is "single", the processing is advanced to the step S1705, and when the opponent's area is "double" or "triple", the processing is advanced to the step S1708.

Step S1705: A point of the hit area is added to the point of the opponent PYj having the hit area and the processing is advanced to the step S1711.

Step S1706: When the hit area is "single", the processing is advanced to the step S1707 and when "double" or "triple", the processing is jumped to the step S1708.

Step S1707: It is judged whether the hit area is hit twice in the current round. If the area is twice hit, the processing is advanced to the step S1708, otherwise, the processing is advanced to the step S1711.

Step S1708: The hit area is obtained by the player PYi and point "20" is added to the player's point Pi. The processing is advanced to the step S1711, next.

For the subtraction of the point Pi, the CPU 301, system memory 302, program data memory medium 303 of the control unit 100 cooperatively perform a function as a subtracting means.

Step S1709: It is judged whether the hit area has been already got, by the player PYi in the current round. If the area has been got in the current round, the processing is advanced to the step S1710, otherwise, the processing is jumped to the step S1711.

Step S1710: The point of the hit area is added to the point Pi of the player PYi and the step is advanced to the step S1711.

For giving the point Pi, the CPU 301, system memory 302, program data memory medium 303 of the control unit 100 cooperatively perform a function as a point giving means. There are two types of point giving means, that is, processing according to the step S1704 and S1707. Here, the former is called the first point giving means and the latter the second point giving means.

Step S1711: It is judged whether the current player PYi has finished the arrow throwing of the current round or not. Each player pushes the player change button PB on finishing the three times arrow throwing of one round. Then, the game machine GM1 detects that the three times arrow throwing has been finished.

If the player is to be changed, the processing is advanced to the step S1712, otherwise, returned to the step S1702.

Step S1712: It is judged whether the arrow hits the target three times in the current round. If the arrow hits the target less than three times, it is regarded that the outboard occurred and a point "20" is given to the opponent.

Step S1713: The point "20" is given to the opponent and the processing is advanced to the step S1714.

Step S1714: If each of the total areas is owned by any one of players, the processing is jumped to the step S1719 for termination.

Step S1715: It is judged whether all the players have finished the arrow throwing of the current round or not, that is, whether the game is to be advanced to the next round or not. When to be advanced to the next round, the processing is advanced to the step S1322 and when the round is not finished, the processing is advanced to the step S1716.

Step S1716: The player to throw the arrows is changed to the player of the next turn and the processing is advanced to the step S1702.

Step S1717: It is judged whether the current round reaches the final round Rmax (round limit) or not. If the current round reaches Rmax, the processing is advanced to the step S1719, otherwise, the processing is advanced to the step S1718.

Step S1718: The player to throw the arrow is returned to the first player and the processing is returned to the step S1702.

Step S1719: The game is judged to be terminated, the players' ranking is shown and the processing is terminated.

For judging the termination of the game in the step S1714 and S1719, the CPU 301, system memory 302, program data memory medium 303 of the control unit 100 cooperatively perform a function as a terminating means.

The third game is highly entertaining since the point is given when one same area is successively and repeatedly hit, adopting a target hitting game.

Therefore, the game is interesting from high strategy, active as well as dynamic point of view.

Since there are player's area and opponents' areas in the target, the arrow throw may be analogous to an attack on the opponent's area. Since the opponent's areas are increased or decreased during playing, an active and dynamic interest is exited.

$4^{th}$ Game "7 CARDS"

Figure 9:
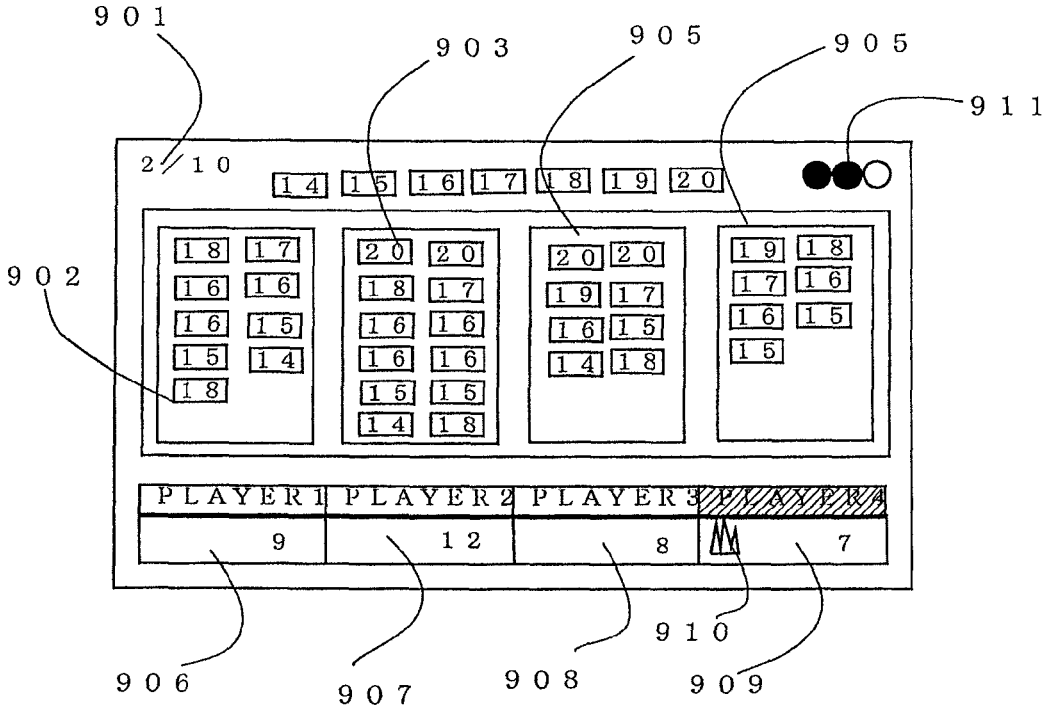
FIG. 9 shows a display image of the fourth game executed in the game machines GM1 to GMn.
Figure 18:
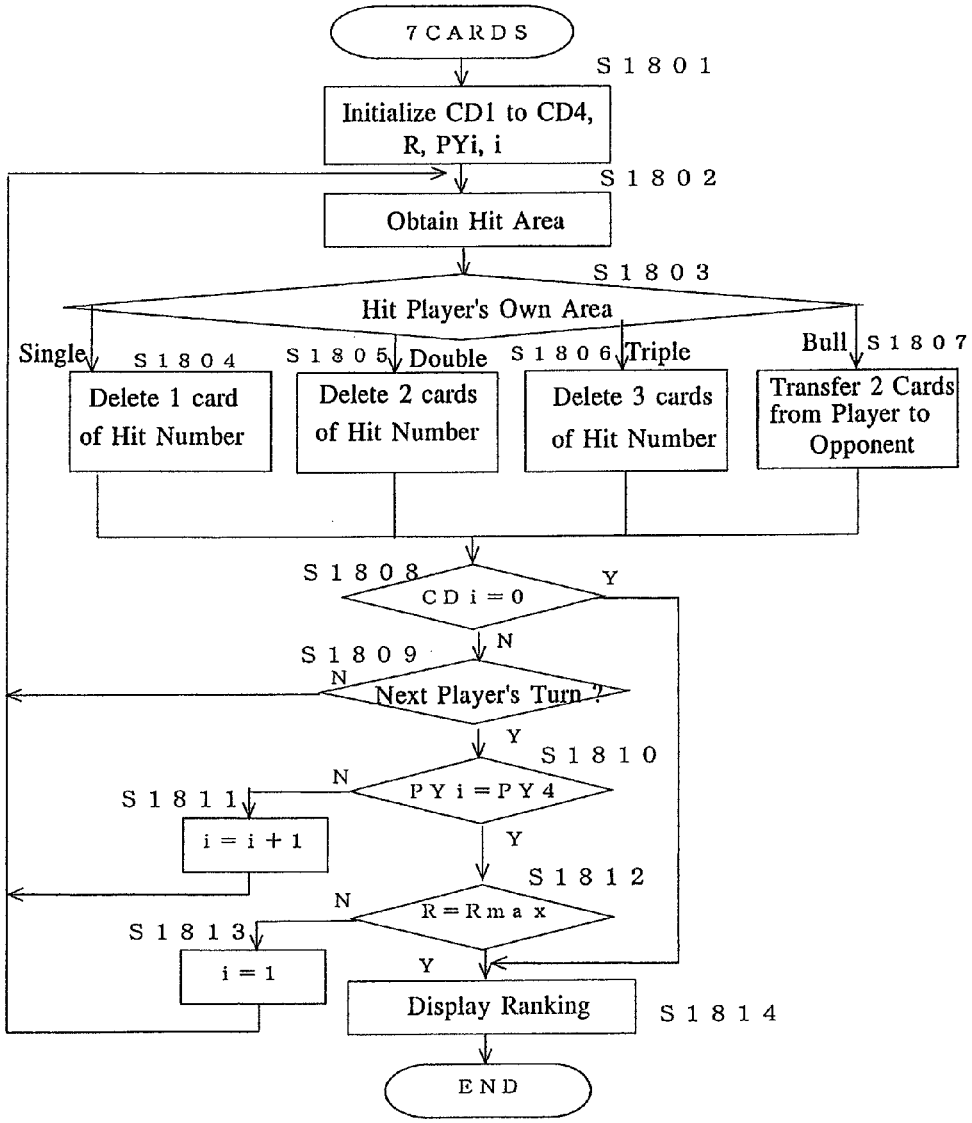
FIG. 18 is a flowchart showing the processing of the fourth game.

FIG. 9 shows a display image (displayed on the CRT 312) of the fourth game (named "7 CARDS") executed in the game machines GM1 to GMn. FIG. 18 is a flowchart showing the processing of the fourth game.

In FIG. 9, 4 players (or 4 teams of players) can be join the fourth game. Each player tries to transfer his own cards to opponents so as to decrease the cards, and the player wins when the total cards have been discharged (transferred to the opponents).

In the display image, display boxes 902, 903, 904 and 905 for indicating each player's cards may be shown so that each player can watch totally the situation of the game and interest in the game is excited. For example, in FIG. 9, cards "18", "16", "16", "15", "18", "17", "16", "15" and "14" held by the first player are indicated in the display box 902, cards "20", "18", "16", "16", "15", "14", "20", "17", "16", "16" and "15", "18" held by the second player are indicated in the display box 903, cards "20", "19", "16", "14", "20", "17", "15" and "18" held by the third player are indicated in the display box 904 and cards "19", "17", "16", "15", "18", "16" and "15" held by the fourth player are indicated in the display box 905.

In the display image, display boxes 906, 907, 908 and 909 are displayed for indicating number of card held by the players. One of the display boxes is colored by a predetermined color for indicating the current player (the fourth player in FIG. 9) throwing the arrow. In the display box of the highest point (the fourth player in FIG. 9), a mark 910 is shown.

In the display image, there are shown a display 901 indicating the current round and the total rounds (In the figure, 2/10 means the second round among the ten rounds.), a display 911 indicating the finished arrows of the current player in the current round, and a display 607 imitating the target for indicating areas obtained by each player. The display 911 has white circles of number of three meaning the total arrow throwing in one round, and circles corresponding to the finished throw are changed to black.

In FIG. 18, the fourth game is executed trough the following steps.

Step S1801: The point Pi, current round R, current player PYi, number CDi of cards held by the player are initialized and values are given to them. The total number of players is judged by number of ID cards inserted into the card reader CD.

Step S1802: Next to the step S1801, the area in the target TG is detected where the arrow hits and a number of the area is obtained.

Step S1803: It is judged which area of single, double, triple or bull is hit by the arrow. When single, the processing is advanced to the step S1804, when double, advanced to the step S1805 and when triple, advanced to the step S1806, when bull, the processing is advanced to the step S1807.

Step S1804: When the area hit by the arrow is single, one card held by the player PYi of the number corresponding to the hit area is deleted.

For eliminating the card, the CPU 301, system memory 302, program data memory medium 303 of the control unit 100 cooperatively perform a function as a card eliminating means.

Step S1805: When the area hit by the arrow is double, two cards held by the player PYi of the number corresponding to the hit area are deleted.

Step S1806: When the area hit by the arrow is triple, three cards held by the player PYi of the number corresponding to the hit area are deleted.

Step S1807: When the area hit by the arrow is bull, two cards held by the player PYi of the number can be transferred to opponents.

For transferring the card, the CPU 301, system memory 302, program data memory medium 303 of the control unit 100 cooperatively perform a function as a card transferring means.

Step S1808; Following to the steps S1804 to S1807, it is judged whether there is a player having no cards or not. If there player of no cards, the processing is jumped to the step S1814, otherwise, the processing is advanced to the step S1809.

Step S1809: It is judged whether the current player has finished the arrow throwing or not. Each player pushes the player change button PB on finishing the three times arrow throwing of one round. Then, the game machine GM1 detects that the three times arrow throwing has been finished.

If the player is to be changed, the processing is advanced to the step S1810, otherwise, returned to the step S1802.

Step S1810: It is judged whether all the players have finished the arrow throwing of the current round or not, that is, whether the game is to be advanced to the next round or not. When to be advanced to the next round, the processing is advanced to the step S1811 and when the round is not finished, the processing is advanced to the step S1812.

Step S1811: The player to throw the arrows is changed to the player of the next turn and the processing is advanced to the step S1802.

Step S1812: It is judged whether the current round reaches the final round Rmax (round limit) or not. If the current round reaches Rmax, the processing is advanced to the step S1814, otherwise, the processing is advanced to the step S1813.

Step S1813: The player to throw the arrow is returned to the first player and the processing is returned to the step S1802.

Step S1814: The game is judged to be terminated, the players' ranking is shown and the processing is terminated.

For judging the termination of the game in the step S1809 and S1814, the CPU 301, system memory 302, program data memory medium 303 of the control unit 100 cooperatively perform a function as a terminating means.

The fourth game makes even a beginner easily join and is highly entertaining with adopting a target hitting game.

Since the areas of the target TG correspond to players and players' cards, the arrow throwing has an image of attack on the opponents and opponents' card deletion. Active and dynamic interest are exited.

[5$^{th}$ Game "CASTLE BOMBER"]

Figure 10:
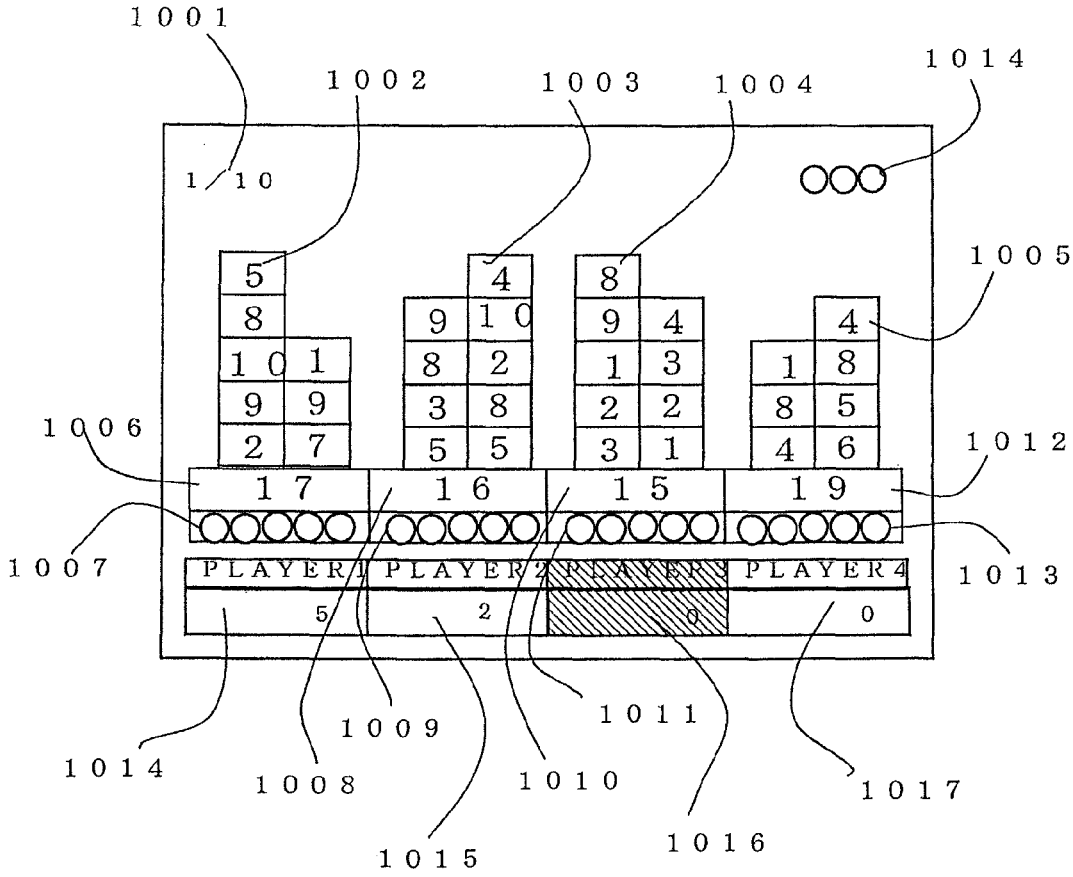
FIG. 10 shows a display image of the fifth game executed in the game machines GM1 to GMn.
Figure 19:
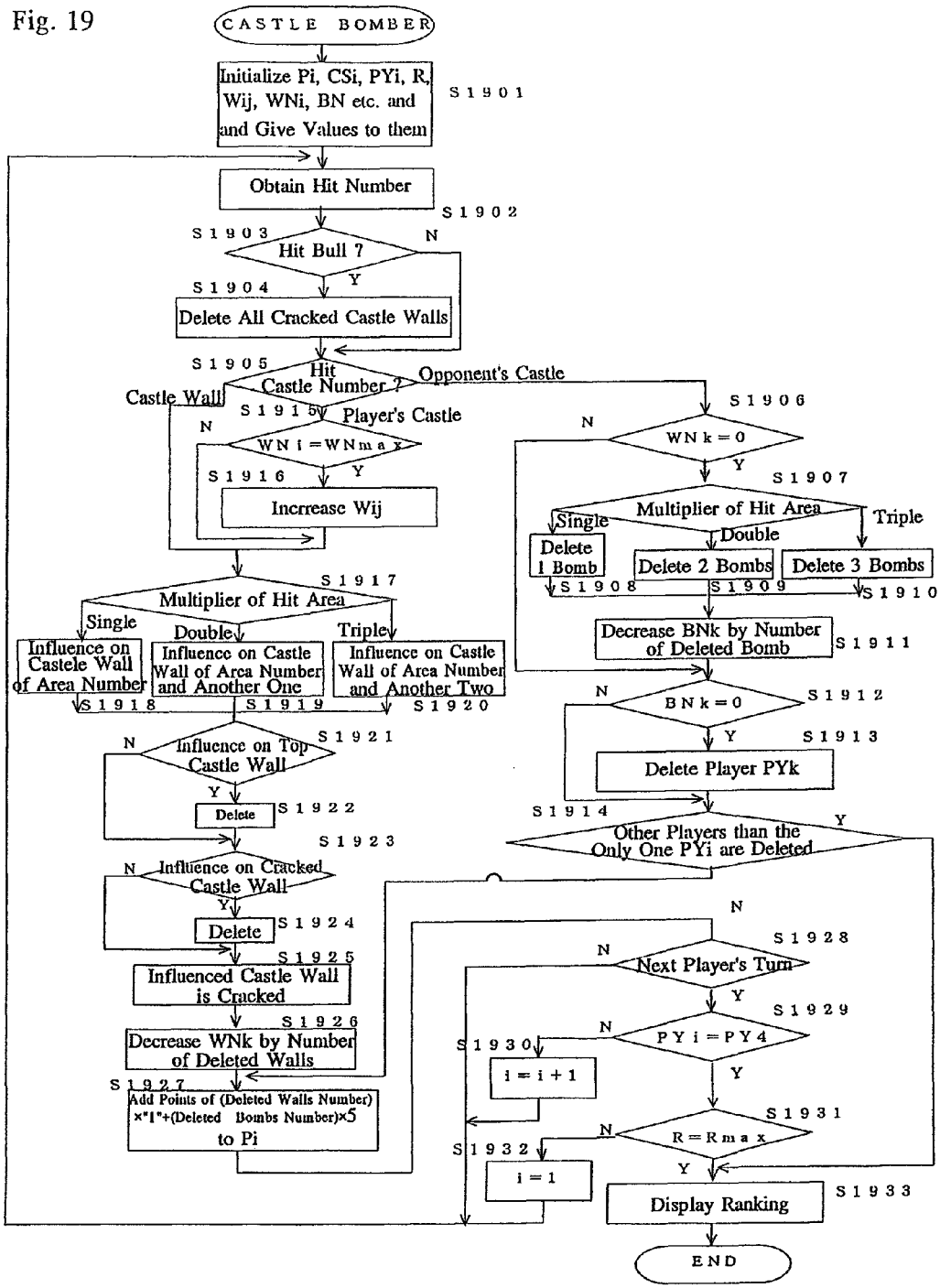
FIG. 19 is a flowchart showing the processing of the fifth game.

FIG. 10 shows a display image (displayed on the CRT 312) of the fifth game (named "CASTLE BOMBER") executed in the game machines GM1 to GMn. FIG. 19 is a flowchart showing the processing of the fifth game.

In FIG. 10, 4 players (or 4 teams of players) can be join the fifth game. Each player tries to attack on opponents' castle according to numbers of the areas in the target TG.

In the display image, there are shown castles 1006, 1008, 1010 and 1012, walls 1002, 1003, 1004 and 1005 of the castles 1006, 1008, 1010 and 1012, respectively, and bombs 1007, 1009, 1011 and 1013 stored in the castles 1006, 1008, 1010 and 1012, respectively.

For example, as shown in FIG. 10, the wall 1002 is constructed by an image expressing stone walls of number of "5", "8", "10", "9", "2", "1", "9" and "7", the wall 1003 is constructed by an image expressing stone walls of number of "9", "8", "3", "5", "4", "10", "2", "8" and "7", the wall 1004 is constructed by an image expressing stone walls of number of "8", "9", "1", "2", "3", "4", "3", "2" and "1" and the wall 1005 is constructed by an image expressing stone walls of number of "1", "8", "4", "4", "8", "5" and "6".

In the display image, display boxes 1014, 1015, 1016 and 1017 are displayed for indicating the total points "17", "16", "15" and "19" obtained by the first, second, third and fourth player, respectively. One of the display boxes is colored by a predetermined color for indicating the current player (the third player in FIG. 10) throwing the arrow.

In the display image, there are shown a display 1001 indicating the current round and the total rounds (In the figure, 1/10 means the first round among the ten rounds.) and a display 1014 indicating the finished arrows of the current player in the current round. The display 1014 has circles of number of three meaning the total arrow throwing in one round, and circles corresponding to arrows hit in the target TG are changed in color, for example.

In FIG. 19, the fifth game is executed through the following steps.

Step S1901: The point Pi, current round R, current player PYi, castle number CSi, castle wall number Wij, bomb number BNi, number of castle walls WM etc. are initialized and values are given to them. The total number of players is judged by number of ID cards inserted into the card reader CD.

Then, items (symbols) are distributed to the players. For distributing the symbols, the CPU 301, system memory 302, program data memory medium 303 of the control unit 100 cooperatively perform a function as a symbol distributing means. By setting the numbers of castles and castle walls, indexes are given to the castles and castle walls. For giving the indexes, the CPU 301, system memory 302, program data memory medium 303 of the control unit 100 cooperatively perform a function as an index giving means.

Step S1902: Next to the step S1901, the area in the target TG where the arrow hit is detected and a number of the area is obtained.

Step S1903: Next to the step S1903, it is judged whether the hit area is bull or not. If the area is bull, the processing is advanced to the step S1904, otherwise, the processing is jumped to the step S1905.

Step S1904: In case of that the hit area corresponds to the top castle walls, when the area is single, only the top castle wall is deleted, when the area is double, vertical two castle walls of the top castle wall and the castle wall under the top are deleted, and when the area is triple, vertical three castle walls from the top castle to the third layer are deleted The castle walls are influenced corresponding to the hit areas in the processing of steps from Step S1905 to S1911 and from S1915 to S1827, as follows.

In case of that the hit area corresponds to the second layer from the top or lower layer castle wall, when the area is single, the castle wall is cracked by the first hit, when the area is double, the castle wall and adjacent upper castle wall to the above castle wall are cracked and when the area is triple, the castle wall and upper and lower adjacent castle walls area cracked. While, when the castle wall corresponding to the area has already been cracked, the castle wall is deleted.

When the hit area is bull, all the cracked castle walls of both the current player and the opponents.

Step S1905: It is judged whether the number of the hit area is a castle number or not. When the hit area is a castle number of an opponent, the processing is advanced to the step S1906, when the player's castle number, the processing is advanced to the step S1915 and when the castle wall number (other numbers), the processing is advanced to the step S1917.

Step S1906: Next to the step S1905, it is judged whether the opponent's castle of the hit number has castle walls remained or not. If the castle has no castle walls, the processing is advanced to the step S1907, otherwise, the processing is jumped to the step S1912.

Step S1907: It is judged which area of single, double or triple is hit by the arrow. When single, the processing is advanced to the step S1908, when double, advanced to the step S1909 and when triple, advanced to the step S1910.

Step S1908: One bomb is deleted of the castle of the hit number and the processing is advanced to the step S1911.

For judging the termination of the game in the step S1809 and S1814, the CPU 301, system memory 302, program data memory medium 303 of the control unit 100 cooperatively perform a function as a terminating means.

Step S1909: Two bombs are deleted of the castle of the hit number and the processing is advanced to the step S1911.

Step S1910: Three bombs are deleted of the castle of the hit number and the processing is advanced to the step S1911.

Step S1911: The number of the deleted bombs is subtracted from the number of bombs BNk and the processing is advanced to the step S1912.

Step S1912: It is judged whether the number of bombs BNk is zero or not. If BNk is zero, the processing is advanced to the step S1913, otherwise, the processing is jumped to the step S1914.

Step S1913: When the number of bombs BNk is zero, the player PYk is deleted and the step S1914 is advanced to the step S1914.

For eliminating the castle, the CPU 301, system memory 302, program data memory medium 303 of the control unit 100 cooperatively perform a function as a castle eliminating means.

Step S1914: It is judged whether the player PYi is only one due to deletion of the player PYk or not. If PYi is only one, the processing is advanced to the step S1933, otherwise, the processing is advanced to the step S1927.

Step S1915: Next to the step S1905, it is judged whether one or more castle walls are deleted of the player or not. When there is a castle wall deleted, the processing is advanced to the step S1916, when all the castle walls are remained, the processing is advanced to the step S1917.

Step S1916: When the hit area is single, "1" is added to the number of castle walls Wij of the player, when double, "2" is added to Wij and when triple, "3" is added to Wij. Then, the processing is advanced to the step S1917. The number of castle walls Wij is limited by a maximum.

For restoring the castle walls, the CPU 301, system memory 302, program data memory medium 303 of the control unit 100 cooperatively perform a function as a castle walls restoring means.

Step S1917: It is judged whether the hit area is single, double or triple. When single, the processing is advanced to the step S1918, when double, to the step S1919 and when triple, to the step S1920.

Step S1918: The castle wall of the number of the hit area is influenced. The influence is that the top castle walls are deleted by the first his and that the second layer castle walls or the lower from the top are cracked by the first hit and deleted by the second hit.

Step S1919: The castle walls of the number of hit area and the lower adjacent castle wall to the above castle wall are influenced.

Step S1920: When the top castle wall is the hit number, the castle wall of the hit number and the adjacent castle walls of lower two layers are influenced. When the second layer castle walls or the lower from the top is the hit number, the castle wall of the hit number and the adjacent castle walls of upper and lower layers are influenced.

Step S1921: It is judged whether any top castle walls are influenced in the steps from S1918 to S1920. If a top castle wall is influenced, the processing is advanced to the step S1922, otherwise, the processing is jumped to the step S1923.

Step S1922: Influenced top castle walls are deleted and the processing is advanced to the step S1923.

Step S1923: It is judged whether any cracked castle walls are influenced in the steps from S1918 to S1920. If a cracked castle wall is influenced, the processing is advanced to the step S1924, otherwise, the processing is jumped to the step S1925.

Step S1925: The influenced (not deleted) castle walls are cracked and the processing is advanced to the step S1926.

Step S1926: Number of deleted castle walls of opponents is subtracted from WNk and the step is advanced to the step S1927.

Step S1927: Points of (number of deleted castle walls)×1+(number of deleted bombs)×5 is added to the point Pi of the player PYi and the step is advanced to the step S1928.

Step S1928: It is judged whether the current player has finished the arrow throwing or not. Each player pushes the player change button PB on finishing the three times arrow throwing of one round. Then, the game machine GM1 detects that the three times arrow throwing has been finished.

If the player is to be changed, the processing is advanced to the step S1929, otherwise, returned to the step S1902.

Step S1929: It is judged whether all the players have finished the arrow throwing of the current round or not, that is, whether the game is to be advanced to the next round or not. When to be advanced to the next round, the processing is advanced to the step S1931 and when the round is not finished, the processing is advanced to the step S1930.

Step S1930: The player to throw the arrows is changed to the player of the next turn and the processing is advanced to the step S1902.

Step S1931: It is judged whether the current round reaches the final round Rmax (round limit) or not. If the current round reaches Rmax, the processing is advanced to the step S1933, otherwise, the processing is advanced to the step S1932.

Step S1923: The player to throw the arrow is returned to the first player and the processing is returned to the step S1902.

Step S1933: The game is judged to be terminated, the players' ranking is shown and the processing is terminated.

The fifth game makes even a beginner easily join and is highly entertaining with adopting the target hitting game.

Since the areas in the target correspond to the castles or castle walls of the player and opponents, the arrow throw may be analogous to defense and offense. An active and dynamic interest is exited.

$6^{th}$ Game "REVERSE36"

Figure 11:
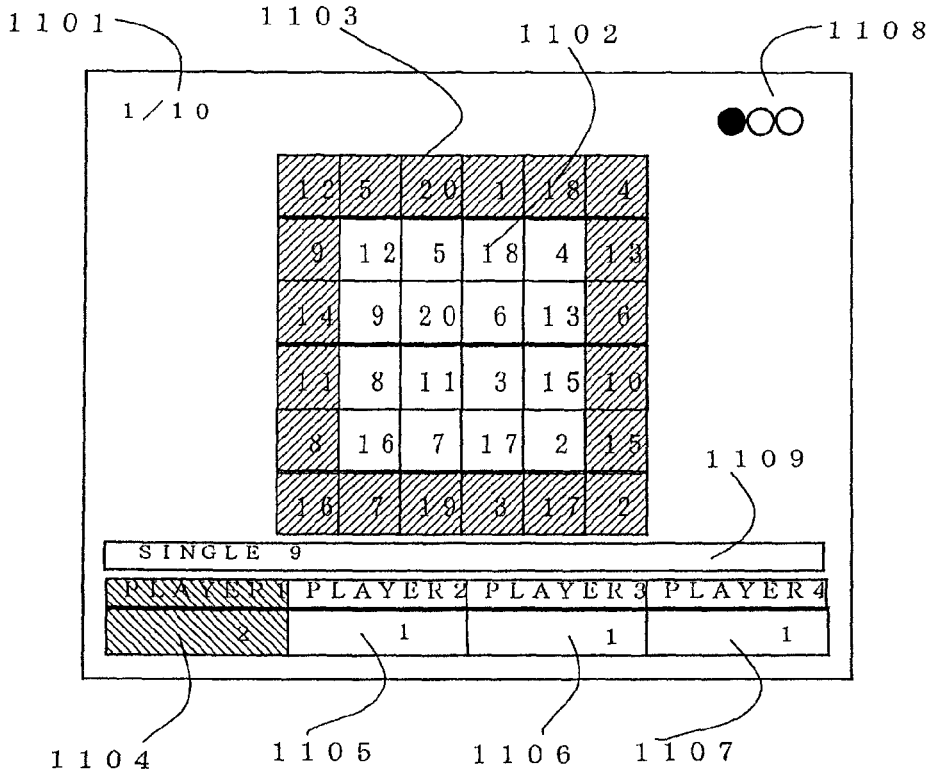
FIG. 11 shows a display image of the sixth game executed in the game machines GM1 to GMn.
Figure 20:
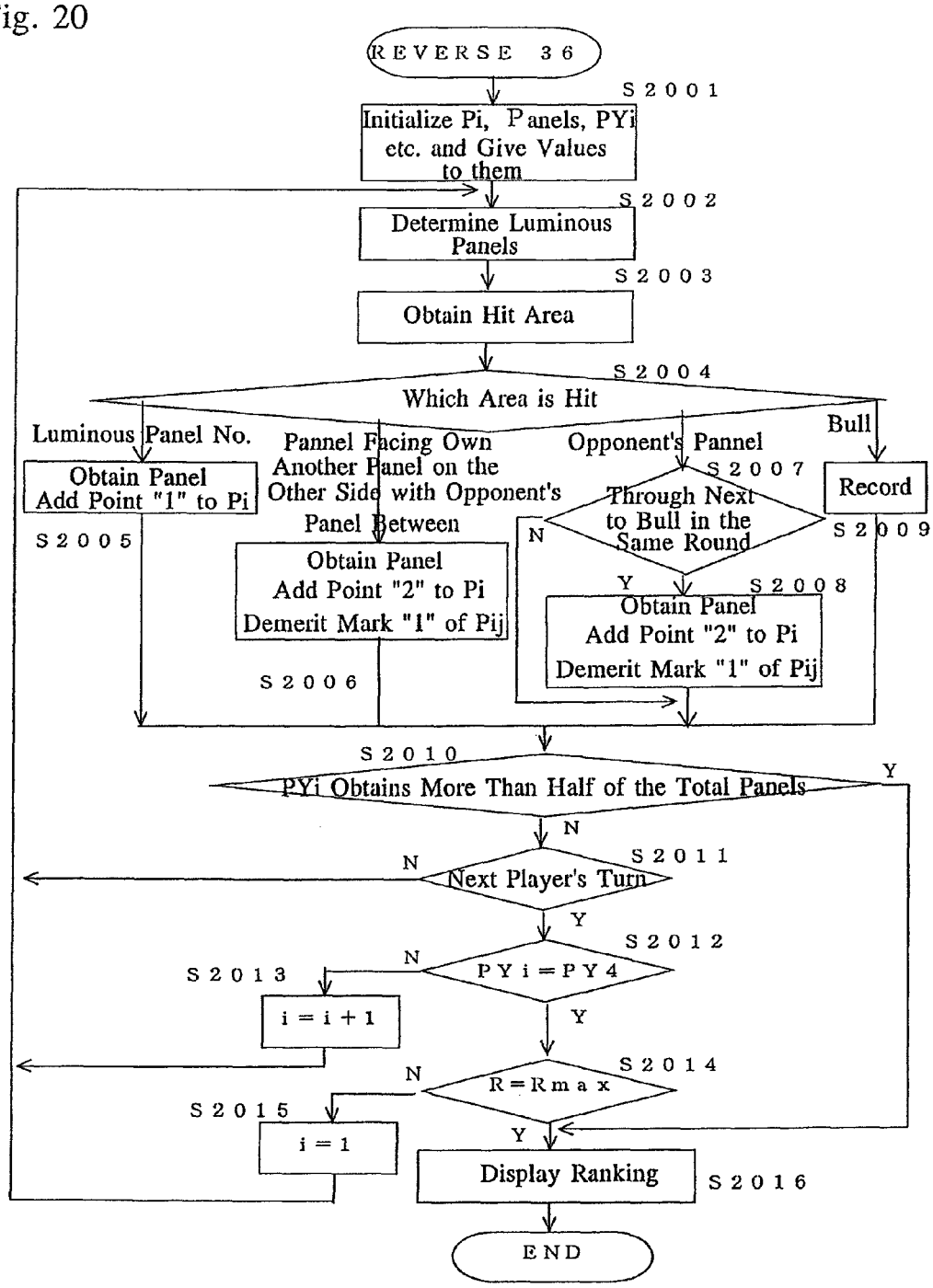
FIG. 20 is a flowchart showing the processing of the sixth game.

FIG. 11 shows a display image (displayed on the CRT 312) of the sixth game (named "REVERSE36") executed in the game machines GM1 to GMn. FIG. 20 is a flowchart showing the processing of the sixth game.

In FIG. 11, 4 players (or 4 teams of players) can be join the first game. Each player tries to get panels corresponding to areas of the target TG.

In the image display, thirty-six panels aligned in a square of 6 rows and 6 columns are shown. Each panel has a number corresponding to an area of the target TG.

In each round of each player, a panel on one side of right or left is brightened adjacent to a panel the current player got. When the player hit an area in the target TG corresponding to the brightened area, the player obtains the brightened panel. When the player gets two panels adjacent to an opponents panel on both sides of right and left or upper and lower, the player obtains the opponent's panel.

The matrix of the panel is divided into a center area 1102 of 4 rows and 4 columns and a area 1103 surrounding the area 1102 of peripheral or border panels. The area 1102 corresponds to single and the area 1103 corresponds to double or triple.

In the display image, display boxes 1104, 1105, 1106 and 1107 indicating number of panels obtained by the first, second, third and fourth players, respectively. One of the display boxes is colored by a predetermined color for indicating the current player (the fourth player in FIG. 11) throwing the arrow.

In the display image, there are shown a display 1101 indicating the current round and the total rounds (In FIG. 11, 1/10 means the first round among the ten rounds.), a display 1108 indicating the finished arrows of the current player in the current round, and a display 1109 imitating the hit area ("9" of single in the figure). The display 1108 has white circles of number of three meaning the total arrow throwing in one round, and circles corresponding to the finished throw are changed to black.

In FIG. 20, the sixth game is executed through the following steps.

Step S2001: The point Pi, current round R, current player PYi and panel etc. are initialized and values are given to them. The total number of players is judged by number of ID cards inserted into the card reader CD.

The indexes allocated to the players. For allocating the indexes, the CPU 301, system memory 302, program data memory medium 303 of the control unit 100 cooperatively perform a function as an index allocating means.

Step S2002: Next to the step S2001, one of panels not geo by the opponents is set as a "brightened panel".

For specifying the panels, the CPU 301, system memory 302, program data memory medium 303 of the control unit 100 cooperatively perform a function as a panel specifying means. And for displaying the panels, the CPU 301, system memory 302, program data memory medium 303 of the control unit 100 cooperatively perform a function as a panel displaying means.

Step S1303: Next to the step S1302, the area in the target TG is detected where the arrow hits, and it is judged whether the hit area is the opponent player's PYj (other players' than the current player) or not. If the area is not the opponent's PYj, the processing is jumped to the step S1306. If the opponent's PYj, it is judged whether the area is the center or side area among the three neighboring area. Among the neighboring three areas "10", "15" and "2", the area "15" is the center and the areas "10" and "2" are the side. When a player possesses just one area, the area is handled as the center.

Step S2003: Next to the step S2002, the area in the target TG is detected where the arrow hits and the number of the area is obtained.

Step S2004: Next to the step S2003, it is judged which of "brightened panel", "panel on an opposite side of opponent's panel to a side adjacent to a player's panel", "opponent's panel" and "bull" the area is. When "brightened panel", the processing is advanced to the step 2005, when "panel on an opposite side of opponent's panel to a side adjacent to a player's panel", to the step S2006, when "opponent's panel", to the step S2007 and when "bull", to the step S2008.

Step S2005: When "brightened panel", the player obtains the panel and the processing is advanced to the step S2010. Then, "1" is added to the point Pi of the player PYi.

For obtaining the panel in the step S2005, the CPU 301, system memory 302, program data memory medium 303 of the control unit 100 cooperatively perform a function as a first panel giving means.

Step S2006: When "panel on an opposite side of opponent's panel to a side adjacent to a player's panel", the player obtains the opponent's panel and the processing is advanced to the step S2010. Then, a point "1" of the obtained panel and a point "1" of the opponent's point the opponent got when he obtained the panel are added to the point Pi of the player PYi. While, a point "1" corresponding to the panel took by the player PYi is subtracted from the point Pj of the opponent PYj.

For obtaining the panel in the step S2006, the CPU 301, system memory 302, program data memory medium 303 of the control unit 100 cooperatively perform a function as a second panel giving means.

Step S2007: When "opponent's panel", it is judged whether "bull" is hit and the opponent's panel is hit first time after the bull hit in the current round. If this condition is fulfilled, the processing is advanced to the step S2003, otherwise, the processing is jumped to the step S2010.

For obtaining the panel in the step S2007, the CPU 301, system memory 302, program data memory medium 303 of the control unit 100 cooperatively perform a function as a third panel giving means.

Step S2008: When "bull" is hit and the opponent's panel is hit first time after the bull hit in the current round, a point "1" of the obtained panel and a point "1" of the opponent's point the opponent got when he obtained the panel are added to the point Pi of the player PYi. While, a point "1" corresponding to the panel took by the player PYi is subtracted from the point Pj of the opponent PYj.

Step S2009: When "bull", the "bull hit" is recorded for the step S2008 that may be executed in the current round.

Step S2010: Following to the steps from S2005 to S2009, it is judged whether the player PYi has obtained more than half of the total panels or not, that is, whether PYi has obtained 19 panels more than 36/2 or not. If more than half of the panels are obtained by the player, the processing is jumped to the step S2016, otherwise, the processing is advanced to the step S2011.

Step S2011: It is judged whether the current player has finished the arrow throwing or not. Each player pushes the player change button PB on finishing the three times arrow throwing of one round. Then, the game machine GM1 detects that the three times arrow throwing has been finished.

If the player is to be changed, the processing is advanced to the step S2012, otherwise, returned to the step S2002.

Step S2012: It is judged whether all the players have finished the arrow throwing of the current round or not, that is, whether the game is to be advanced to the next round or not. When to be advanced to the next round, the processing is advanced to the step S2013 and when the round is not finished, the processing is advanced to the step S2014.

Step S2013: The player to throw the arrows is changed to the player of the next turn and the processing is advanced to the step S2002.

Step S2014: It is judged whether the current round reaches the final round Rmax (round limit) or not. If the current round reaches Rmax, the processing is advanced to the step S2016, otherwise, the processing is advanced to the step S2015.

Step S2015: The player to throw the arrow is returned to the first player and the processing is returned to the step S2002.

Step S2016: The game is judged to be terminated, the players' ranking is shown and the processing is terminated.

The sixth game makes even a beginner easily join and is highly entertaining with adopting the target hitting game.

Since the panels can be got by various manners, the players compete with one another not only in arrow throwing skill but also in high order strategic operation. The panel can be obtained by two panels on opposite sides of opponent panel, so superiority and inferiority may be easily overturned at the final phase.

$7^{th}$ Game "RESERVATION"

Figure 12:
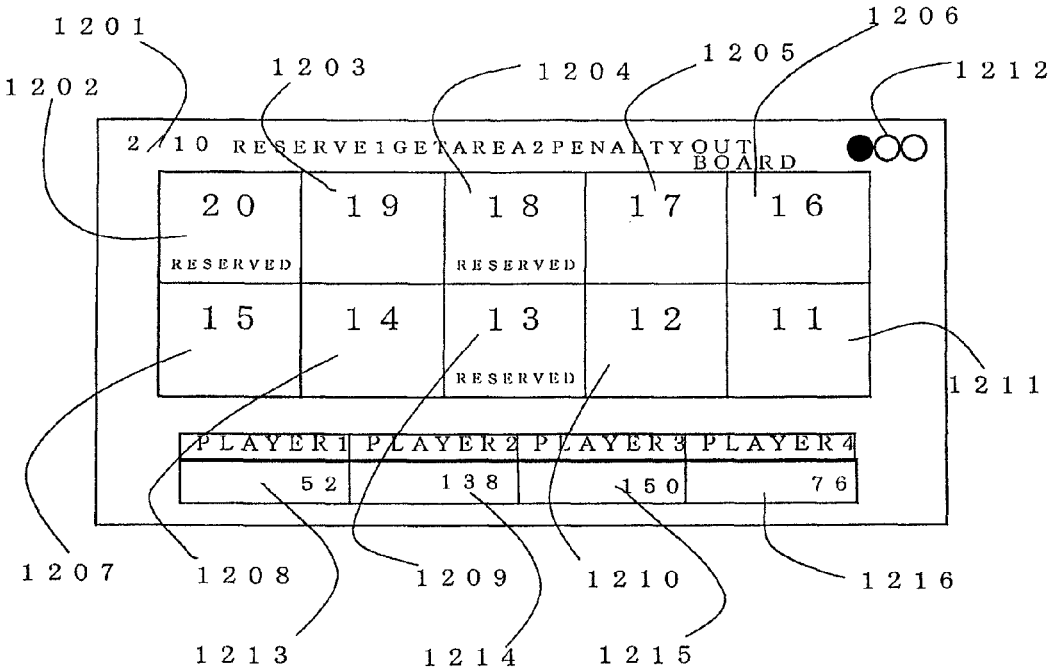
FIG. 12 shows a display image of the seventh game executed in the game machines GM1 to GMn.
Figure 21:
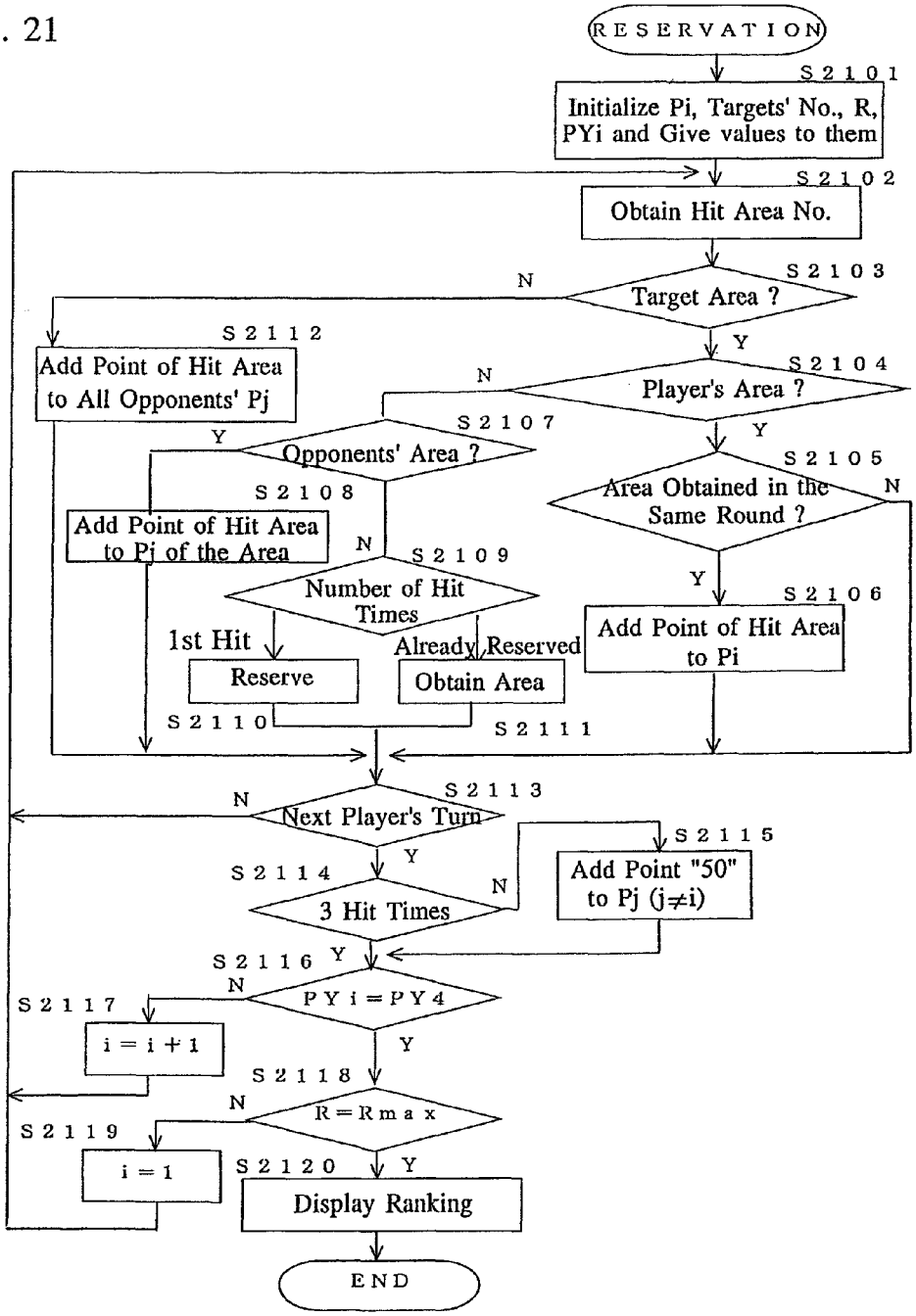
FIG. 21 is a flowchart showing the processing of the first game.

FIG. 12 shows a display image (displayed on the CRT 312) of the seventh game (named "RESERVATION") executed in the game machines GM1 to GMn. FIG. 21 is a flowchart showing the processing of the first game.

In FIG. 12, 4 players (or 4 teams of players) can be join the seventh game. Each player tries to get the fan-shaped area of the target TG and to get points by hitting player's area.

In the display image, ten panels 1202, 1203, 1204, 1205, 1206, 1207, 1208, 1209, 1210 and 1211 (their numbers are called "target No.") partially corresponding to the fan-shaped areas of the target TG. Panels (areas) got by the opponents are distinguished by a predetermined color.

In the display image, display boxes 1213, 1214, 1215 and 1216 are shown for indicating players' points. For example, a point "52" of the first player is shown in the display box 1213, a point "138" of the second player is shown in the display box 1214, a point "150" of the third player is shown in the display box 1215 and a point "76" of the fourth player is shown in the display box 1216.

In the display image, there are shown a display 1201 indicating the current round and the total rounds (In the figure, 2/10 means the second round among the ten rounds.), a display 1212 indicating the finished arrows of the current player in the current round. The display 1212 has circles of number of three meaning the total arrow throwing in one round, and circles corresponding to the arrows which hit the target are changed in color.

In FIG. 21, the seventh game is executed through the following steps.

Step S2101: The point Pi, current round R, current player PYi, target No. are initialized and values are given to them. The total number of players is judged by number of ID cards inserted into the card reader CD.

For setting number of targets, the CPU 301, system memory 302, program data memory medium 303 of the control unit 100 cooperatively perform a function as a setting means.

Step S2102: Next to the step S2101, the area in the target TG is detected where the arrow hits and a number of the area is obtained.

For obtaining the areas, the CPU 301, system memory 302, program data memory medium 303 of the control unit 100 cooperatively perform a function as a area giving means.

Step S2103: Next to the step S2101, it is judged whether the hit area is the area of the target No. If the area is the area of the target No., the processing is advanced to the step S2104, otherwise, the processing is advanced to the step S2112.

Step S2104: It is judged whether the hit area is the player's area or not. If the area is the player's area, the processing is advanced to the step S2105, otherwise, the processing is advanced to the step S2107.

Step S2105: It is judged whether the hit area has been already got, by the player PYi in the current round. If the area has been got in the current round, the processing is advanced to the step S2106, otherwise, the processing is jumped to the step S2113.

Step S2106: The number of the hit area is added to the point Pi of the player PYi and the processing is advanced to the step S2113.

For obtaining the areas, the CPU 301, system memory 302, program data memory medium 303 of the control unit 100 cooperatively perform a function as a area giving means.

Step S2107: It is judged whether the hit area is the player's area or not. If the area is the player's area, the processing is advanced to the step S2108, otherwise, the processing is advanced to the step S2109.

Step S2108: The number of the hit area is added to the point Pi of the player PYi and the processing is advanced to the step S2113.

Step S2109: The number of times of arrow hit in the hit area. As for other areas than opponents' areas, each player obtains an area by hitting twice in one or more rounds. The area hit first is "reserved" (It is reserved that the area is obtained by the next hit.). When the area is first hit, the processing is advanced to the step S2110 for the "reserve". When the reserved area is hit, the processing is advanced to the step S2111 for obtaining the area. When a hit area has been already reserved by an opponent, the opponent's "reserve" is cancelled and the player's "reserve" is effective.

Step S2110: The hit area is reserved for the player PYi.

Step S2111: The player PYi obtains the reserved area where the arrow hits and the processing is advanced to the step S2213.

Step S2112: The number of the hit area is added to the points of all the opponents and the processing is advanced to the step S2213.

Step S2113: It is judged whether the current player has finished the arrow throwing or not. Each player pushes the player change button PB on finishing the three times arrow throwing of one round. Then, the game machine GM1 detects that the three times arrow throwing has been finished.

If the player is to be changed, the processing is advanced to the step S2114, otherwise, returned to the step S2102.

Step S2114: It is judged whether the arrow hits the target three times in the current round. If the arrow hits the target less than three times, it is regarded that the outboard occurred and a point "50" is given to the opponent.

Step S2115: The point "50" is given to the opponent and the processing is advanced to the step S2116.

Step S2116: It is judged whether all the players have finished the arrow throwing of the current round or not, that is, whether the game is to be advanced to the next round or not. When to be advanced to the next round, the processing is advanced to the step S2118 and when the round is not finished, the processing is advanced to the step S2117.

Step S2117: The player to throw the arrows is changed to the player of the next turn and the processing is advanced to the step S2102.

Step S2118: It is judged whether the current round reaches the final round Rmax (round limit) or not. If the current round reaches Rmax, the processing is advanced to the step S2120, otherwise, the processing is advanced to the step S2119.

Step S2119: The player to throw the arrow is returned to the first player and the processing is returned to the step S2102.

Step S2120: The game is judged to be terminated, the players' ranking is shown and the processing is terminated.

The seventh game makes even a beginner easily join and is highly entertaining

Since the areas in the target correspond to player's and opponents' areas, the arrow throw may be analogous to offense and defense and, an active and dynamic interest is exited.

However, in the above embodiment, "darts" is adopted as a target hitting game, any other target hitting game may be adoptable. The indexes of areas in the target are not limited to from numerals from "1" to "20", and any other characters, words and pictures may be applied.

The games executed in the game machine are not limited to the above, any games executed on a display monitor adopting a target hitting game may be applied.

ADVANTAGES

According to the present invention, a beginner can easily join and feel a lot of entertainment in a game adopting a target hitting game.

The present application hereby incorporates by reference the entire disclosure of Japan Patent Application No. 2003-372553, filed with the present application.

The invention claimed is:

1. A game machine comprising:

a player identification device configured to identify participant players who are to participate in a series of a same game on the game machine;

a game mode selection means provided with plural game modes configured to be selectable by the participant players, said game modes including a mode of changing playing orders during the game series;

a target against which the participant players throw darts in turn;

a detector configured to detect which regions of the target have been hit by the darts thrown by the participant players;

a control unit configured to control the progresses of the game performed by the participant players, wherein, at each game in the game series, the participant players throw darts in turn against the target and are given certain scores based on the regions on the target which the participant players have hit with the darts, respectively; and a display monitor controlled by said control unit to show information relating to results performed by said participant players;

wherein said control unit is configured to control the progresses of the game, when the mode of changing playing orders is selected, by at least performing so as to:

(a) determine a playing order of throwing darts for a first game among the participant players in a way determined by the control unit;

(b) calculate the score for the first game performed by each of the participant players based on the results detected by the detector to determine the player who has marked the lowest score among said participant players; and (c) determine a new playing order of throwing darts among the participant players for a second game in the game series such that the participant player who has marked the lowest score among said participant players in the first game is placed first to play in the second game.

2. A game machine comprising:

a player identification device configured to identify participant players who are to participate in a series of a same game on the game machine;

a game mode selection means provided with plural game modes configured to be selectable by the participant players, said game modes including a mode of changing playing orders during the game series;

a control unit configured to control progresses of a game performed by the participant players, wherein, at each game of the game series the participant players perform game plays with the game machine in turn and are given certain scores based on results of the game plays performed by the participant players, respectively; and a display monitor controlled by said control unit to indicate information relating to the results performed by the participant players;

wherein said control unit is configured to control the progresses of the game, when the mode of changing playing orders is selected, by at least performing so as to:

(a) determine a playing order for a first game among the participant players in a way determined by the control unit;

(b) calculating the score for the first play game attained by each of the participant players to determine the player who has marked the lowest score among said participant players; and (c) determine a new playing order among said participant players for a second game such that the participant player who has marked the lowest score among said participant players in the first game is placed first to play in the second game.

3. A game apparatus comprising:

a player-specifying means configured to specify players to participate in a series of a same game on the game apparatus;

a game mode selection means wherein the game modes include a mode of changing turns of plays during the game series;

a calculation means configured to calculate scores of the respective players and to determine relative positions among the players based on the scores at every game of the game series;

a setting means configured to set turns of plays in each game; and a control means configured to control progresses of the games, when the mode of changing turns of plays is selected, by at least performing:

to set a turn of plays for a first game in a way determined under the control of the control unit; and to change the turn of plays for a second game such that the loser of the first game is placed first to play in the second game.

4. A game control method executable by a game machine, wherein said game machine comprises:

a player identification device configured to identify participant players who are to participate in a series of a same game on the game machine;

a game mode selection means provided with plural game modes configured to be selectable by the participant players, said game modes including a mode of changing playing orders during the game series;

a target against which the participant players throw darts in turn;

a detector configured to detect which regions of the target have been hit by the darts thrown by the participant players; and a control unit configured to control progresses of the game performed by the participant players, wherein at each game of the plurality of game series, the participant players throw darts in turn against the target and are given certain scores based on the regions on the target which the participant players have hit with the darts, respectively, said game control method comprising, when the mode of changing playing orders is selected, at least the steps of;

(a) determining the participant players for the game to start on the game machine;

(b) determining a playing order of throwing darts for a first game among the participant players in a way determined by the control unit;

(c) calculating the scores performed by the participant players for the first game to determine the player who has marked the lowest score among said participant players;

(d) determining a new playing order of throwing darts among said participant players for a second game such that the participant player who has marked the lowest score in the first game is placed first to play in the playing order in the second game; and (e) determining the winner for the current game among the participant players when all of the games for the current game series have finished.

5. A game control method executable by a game machine, wherein said game machine comprises:

a player identification device configured to identify participant players who are to participate in a series of a same game on the game machine;

a game mode selection means provided with plural game modes configured to be selectable by the participant players, said game modes including a mode of changing playing orders during the game series; and a control unit configured to control progresses of the game performed by the participant players, wherein, at each game of the game series, the participant players perform game plays with the game machine in turn and are given certain scores based on results of the game plays performed by the participant players, respectively, said game control method comprising, when the mode of changing playing orders is selected, at least the steps of:

(a) determining the participant players for the game series to start;

(b) determining a playing order for a first game among the participant players in a way determined by the control unit;

(c) calculating the score attained by each of the players for the first game to determine the player who has marked the lowest ranking for the first game; and (d) determining a new playing order among said participant players for a second game such that the player who has marked the lowest ranking in the first game is placed first to play in the playing order in the second game.

6. A game control method for a game apparatus wherein a series of a same game is performed among participant game players on the game apparatus by playing plural games against one another, the method comprising at least the steps of:

(a) specifying by a player identification device of the game apparatus the game players to participate in the game to be performed on the game apparatus based on data input to the game apparatus by the game players;

(b) receiving selection by the participant game players of one game mode among a plurality of game modes provided on the game apparatus;

(c) determining by the control unit a playing order for a first game;

(d) calculating by the control unit scores of the respective participant game players for the first game to determine relative positions among the participant game players based on the scores; and (e) determining by the control unit, when the mode of changing playing orders is selected, a playing order for a second game such that the participant game player having a worst relative position for the first game based on said calculating is placed first to play in the playing order for the second game.

* * * * *